US006945043B2

(12) United States Patent
Okano et al.

(10) Patent No.: US 6,945,043 B2
(45) Date of Patent: Sep. 20, 2005

(54) STIRLING ENGINE, AND STIRLING REFRIGERATOR

(75) Inventors: Satoshi Okano, Yao (JP); Shohzoh Tanaka, Nara (JP); Kazuhiko Ueda, Nara (JP); Yoshiyuki Kitamura, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 236 days.

(21) Appl. No.: 10/450,416

(22) PCT Filed: Dec. 7, 2001

(86) PCT No.: PCT/JP01/10762

§ 371 (c)(1),
(2), (4) Date: Jun. 13, 2003

(87) PCT Pub. No.: WO02/048533

PCT Pub. Date: Dec. 7, 2002

(65) Prior Publication Data

US 2004/0025502 A1 Feb. 12, 2004

(30) Foreign Application Priority Data

| | | |
|---|---|---|
| Dec. 13, 2000 | (JP) | 2000-378701 |
| Dec. 18, 2000 | (JP) | 2000-383686 |
| Jun. 29, 2001 | (JP) | 2001-199926 |
| Jul. 24, 2001 | (JP) | 2001-223267 |

(51) Int. Cl.[7] ..... F01B 29/10; F02G 1/04; F02G 1/053; F25B 9/00; F25B 9/14

(52) U.S. Cl. ..... 60/517; 60/520; 60/522; 60/525; 60/526; 62/6

(58) Field of Search ..... 60/517, 518, 519, 60/520, 521, 522, 523, 524, 525, 526; 62/6

(56) References Cited

U.S. PATENT DOCUMENTS

| | | | | |
|---|---|---|---|---|
| 4,811,563 A | | 3/1989 | Furuishi et al. | |
| 5,590,526 A | * | 1/1997 | Cho | 60/517 |
| 6,363,727 B1 | * | 4/2002 | Hashimoto et al. | 62/6 |
| 2004/0025502 A1 | * | 2/2004 | Okano et al. | 60/517 |

FOREIGN PATENT DOCUMENTS

| | | | | | |
|---|---|---|---|---|---|
| JP | 61-152946 A | | 7/1986 | | |
| JP | 61-210276 A | | 9/1986 | | |
| JP | 5-73471 U | | 10/1993 | | |
| JP | 5-296245 A | | 11/1993 | | |
| JP | 5-322346 A | | 12/1993 | | |
| JP | 6-307448 A | | 11/1994 | | |
| JP | 7-4762 A | | 1/1995 | | |
| JP | 7-324831 A | | 12/1995 | | |
| JP | 9-152211 A | | 6/1997 | | |
| JP | 2000-2470 A | | 1/2000 | | |
| JP | 2000-39222 A | | 2/2000 | | |
| JP | 2000-45867 A | | 2/2000 | | |
| JP | 2000-46431 A | | 2/2000 | | |
| JP | 2002180901 A | * | 6/2002 | | F25B/9/14 |
| JP | 2003013804 A | * | 1/2003 | | F25B/9/14 |
| WO | WO 95/26070 A1 | | 9/1995 | | |

* cited by examiner

*Primary Examiner*—Sheldon J Richter
(74) *Attorney, Agent, or Firm*—Birch, Stewart, Kolasch & Birch, LLP

(57) ABSTRACT

A Stirling engine comprises a first porous body having a large hole diameter, a second porous body having a small hole diameter and a ring for fixing the first porous body and the second porous body in a pressurization chamber inside a gas outlet closer to the pressurization chamber.

19 Claims, 16 Drawing Sheets

STIRLING ENGINE, AND STIRLING REFRIGERATOR

This application is the National Phase under 35 U.S.C. §371 of PCT International Application No. PCT/JP01/10762, which has an international filing date of Dec. 7, 2001, which designated the United States of America.

TECHNICAL FIELD

The first invention relates to a Stirling engine, and more specifically, it relates to the structure of a Stirling engine capable of reliably effusing gas during operation with no clogging in a gas effusion part in a gas effusion structure of a gas bearing applied to each sliding part of the Stirling engine.

The second invention relates to a Stirling engine formed by arranging an effector in a cylinder filled up with high-pressure gas for abruptly expanding the high-pressure gas by reciprocation of the effector thereby absorbing external heat and reducing the external temperature.

The third invention relates to a Stirling engine, and more specifically, it relates to a free-piston Stirling engine.

BACKGROUND ART (First Prior Art)

First prior art is described. Friction on a sliding part employed for a Stirling engine remarkably influences performance and reliability of the Stirling engine, and hence a conventional Stirling engine employs a gas effusion structure utilizing a gas bearing effect for a sliding part thereby reducing friction on the sliding part.

The following two examples can be generally listed as the conventional gas effusion structure utilizing a gas bearing effect. FIG. 31 schematically shows a first gas effusion structure. As shown in this figure, a small hole 121 formed by drilling is provided on a gas outlet of a piston 103 which is a motional body provided in a cylinder 102 for effusing gas from this small hole 121 thereby forming a hydrostatic gas bearing between sliding surfaces of the cylinder 102 and the piston 103. This system is referred to as an orifice system.

FIG. 32 schematically shows a second gas effusion structure. As shown in this figure, an air-permeable porous body 122 having innumerable pores in its material is arranged on a gas outlet of a piston 103 which is an effector provided in a cylinder 102 for effusing gas from this porous body 122 thereby forming a hydrostatic gas bearing between sliding surfaces of the cylinder 102 and the piston 103.

Problems in the case of employing the aforementioned hydrostatic gas bearings employing gas bearing effects for the sliding parts of the aforementioned Stirling engines are now described.

In the orifice system according to the firs gas effusion structure shown in FIG. 31, flow loss of the gas from the gas outlet must be reduced in order to improve performance of the Stirling engine. Therefore, the pore size of the gas outlet has been remarkably reduced. However, there has been such a problem that dust in assembling of the Stirling engine or abrasive powder resulting from friction during operation flocculates and clogs the gas outlet to unidirectionally press the piston due to heterogeneity of the gas outflow from each gas outlet, leading to reduction of reliability of operation of the Stirling engine.

In the second gas effusion structure shown in FIG. 32, a large number of pores are present in the porous body 122 dissimilarly to the orifice system and hence the pore diameter of the porous body 122 must be remarkably reduced in order to narrow down the gas outflow from each gas outlet while there has been such a problem that abrasive powder or the like clogs the pores when the pore diameter is reduced.

(Second Prior Art)

Second prior art is described. FIG. 33 is a sectional view showing the structure of a conventional Stirling engine. Referring to FIG. 33, numeral 281 denotes a cylinder-like pressure vessel, and this pressure vessel 281 is filled up with high-pressure helium gas (hereinafter referred to as gas) as a medium. A columnar piston 282 having a through hole 282*a* is arranged in the pressure vessel 281 while matching the central axis with the pressure vessel 281, while a columnar displacer 283 having a through part 283*a* passing through the through hole 282*a* of the piston 282 on an end thereof is also arranged.

The piston 282 is linearly driven by a piston driver (not shown) consisting of a linear motor or the like in the axial direction of the pressure vessel 281, for compressing and expanding the gas in the pressure vessel 281. The piston 282 is supported by a spring 284 on an end (right end in the figure) of the pressure vessel 281 opposite to the displacer 283, not to deviate from a prescribed region.

The through part 283*a* is supported by a spring 285 on the end (right end in the figure) of the pressure vessel 281 so that the displacer 283 does not deviate from the prescribed region either. The piston 282 moves in the direction of the displacer 283 (leftward in the figure) thereby compressing the gas between the piston 282 and the displacer 283, so that the displacer 283 moves in the direction opposite to the piston 282 (leftward in the figure). Then, the piston 282 moves in the direction opposite to the displacer 283 (rightward in the figure) thereby expanding the gas between the piston 282 and the displacer 283, so that the displacer 283 moves in the direction of the piston 282 (rightward in the figure). The piston 282 repeats reciprocation so that the displacer 283 also repeats the aforementioned motion, for compressing and expanding the gas.

An end (left end in the figure) of the pressure vessel 281 opposite to the piston 282 side of the displacer 283 is formed as a cooling part 290, and the said cooling part 290 absorbs external heat for reducing the external temperature when the gas between the cooling part 290 and the displacer 283 is expanded.

The piston 282 and the displacer 283 reciprocate at a high speed during operation of the Stirling engine, and hence friction on sliding parts between the respective ones of the piston 282 and the displacer 283 and the pressure vessel 281 remarkably influences performance and reliability of the Stirling engine. Therefore, reduction of friction on the said sliding parts is attempted.

The structure of the piston 282 for reducing friction on the said sliding parts is now described. The displacer 283 also employs a similar structure.

The piston 282 is in the form of a column having the through hole 282*a*, and includes a cylindrical pressurization chamber 286 matching its central axis with the through hole 282*a* inside the peripheral wall. A side wall (left side in the figure) on the displacer 283 side of the piston 282 has a one-way valve 287 inwardly directed from outside the pressurization chamber 286, so that the high-pressure gas compressed by reciprocation of the piston 282 and the displacer 283 flows into and is stored in the pressurization chamber 286 through the said one-way valve 287, thereby maintaining a high pressure in the pressurization chamber 286.

A plurality (e.g., four equal-scale magnifications) of gas ports 288 are provided on a substantially central portion of the outer peripheral wall of the piston 282, and an annular porous body 289 is arranged in the pressurization chamber 286 thereby blocking open ends of the gas ports 288 closer to the pressurization chamber 286. The porous body 289 is so annularly formed as to solely block all gas ports 288.

The high-pressure gas in the pressurization chamber 286 is injected to the sliding part between the piston 282 and the pressure vessel 281 through the porous body 289 from the gas ports 288. The high-pressure gas is so injected through the porous body 289 that the porous body 289 traps dust etc. contained in the flow of the high-pressure gas while friction on the sliding part between the piston 282 and the pressure vessel 281 can be reduced by reducing the quantity of the injected gas.

The aforementioned structure is so provided in the displacer 283 that friction on the sliding part between the displacer 283 and the pressure vessel 281 can be reduced.

In the Stirling engine having the aforementioned structure, the quantities of the gas injected from the respective gas ports 288 are so uniformized that the piston 282 and the displacer 283 can stably reciprocate with low friction with respect to the pressure vessel 281.

However, adhesion between the porous body 289 and the piston 282 or the displacer 283 is not uniformized due to dispersion in shape accuracy of the piston 282, the displacer 283 and the porous body 289. Further, the piston 282 and the displacer 283 reciprocate at a high speed during operation of the Stirling engine, and hence the porous body 290 may move from a prescribed position when the said adhesion is weak. Therefore, the flow path of the gas is instable, and hence the quantities of the gas injected from the respective gas ports are so non-constant that the piston 282 and the displacer 283 cannot stably reciprocate.

(Third Prior Art)

Third prior art is described. A Stirling engine compresses and expands working gas filling up a cylinder thereby implementing a known Stirling cycle. In a crank type Stirling engine, a piston and a displacer are fixed by a shaft so that the piston and the displacer mechanically move while keeping constant relation thereby implementing the Stirling cycle. In a free-piston Stirling engine, on the other hand, a piston and a displacer are connected to/supported on a casing or the like respectively by coil springs or the like, for example, to operate with individual reciprocation characteristics. FIG. 34 shows an example of this free-piston Stirling engine.

As shown in FIG. 34, a piston 303 and a displacer 302 are coaxially engaged in a cylinder 301 having a cylindrical space therein in the free-piston Stirling engine, thereby sectionally forming a compression space 304 between the piston 303 and the displacer 302, an expansion space 305 between the displacer 302 and a closed end of the cylinder 301 and a back pressure space 306 in a space of the piston 303 opposite to the compression space 304 respectively. The compression space 304 and the expansion space 305 communicate with each other through a regenerator 307, so that working gas filling up this closed circuit serves as a working medium for a Stirling cycle.

The back pressure space 306 is also filled up with gas. However, the gas in this back pressure space 306 acts on none of a compression cycle, an expansion cycle and an isochoric cycle in the Stirling engine. In the Stirling engine, however, the amplitude center position of the piston 303 must be prevented from fluctuation and hence a communication path is generally provided for keeping pressure balance between the compression space 304 and the back pressure space 306.

For example, Japanese Patent Laying-Open No. 2000-39222 proposes a structure forming a communication path 315 by an in-piston communication path 315*a* provided in the piston and a communication hole 315*b* formed on a cylinder wall surface for coupling the in-piston communication path 316*a* and the communication hole 315*b* with each other when the piston 303 is located on its amplitude center position thereby keeping pressure balance between the compression space 304 and the back pressure space 306, as shown in FIG. 34.

When excessive gas circulates through this communication path 315, however, compressibility of the compression space 304 is reduced to cause miscellaneous loss in the Stirling engine, leading to reduction in capability. In the Stirling engine, therefore, miscellaneous loss of the Stirling engine resulting from excess gas flow must be suppressed as low as possible by controlling the flow rate of the gas circulating through the communication path 315.

In the aforementioned free-piston Stirling engine, the diameter of the communication path has been designed in response to the specifications of the Stirling engine. However, the optimum gas flow rate varies from moment to moment with the operational situation of the Stirling engine, and hence miscellaneous loss is not yet completely eliminated. If specification change is made, design of the piston itself must be restarted, leading to an enormous cost for the specification change.

In the crank type Stirling engine, a valve controlling the flow rate of the gas circulating through the communication path can be provided in the communication path due to its structure, while it is impossible to provide such a valve in the communication path in the free-piston Stirling engine.

As another factor for miscellaneous loss of the free-piston Stirling engine having the piston and displacer coaxially engaged for reciprocation, vibration of the Stirling engine itself can be listed. While a dynamic vibration damping mechanism consisting of a mass part and an elastic part can suppress this vibration of the Stirling engine itself, this results in motion loss caused by air resistance, and further results in noise. In general, absolutely no example has reduced motion loss by improving the structure of this dynamic vibration damping mechanism.

(Fourth Prior Art)

Fourth prior art is described. FIG. 35 shows the structure of a free-piston Stirling refrigerator utilizing resonance of a spring as an exemplary conventional Stirling refrigerator. A casing 414 roughly includes a working space 412 and a driving space 413. The working space 412 further consists of an expansion space 406 and a compression space 407, and the working space 412 is filled up with working gas. A first cylinder 403 is arranged along a direction connecting the expansion space 406 and the compression space 407 in the casing 414. A displacer 402 is arranged inside the first cylinder 403 to be reciprocative along the longitudinal direction of the first cylinder 403. A rod 409 extends from the displacer 402 oppositely to the expansion space 406 along the reciprocatory direction, and is elastically connected to the casing 414 by a displacer plate spring 411.

A piston 401 is arranged on a side of the displacer 402 closer to the compression space 407 to enclose the rod 409, and a second cylinder 415 is arranged to enclose the piston 401. The piston 401 is driven by a linear motor 408 arranged in the driving space 413, to be reciprocative for expanding and compressing the compression space 407 in the second cylinder 415 in a prescribed cycle. The piston 401 is elastically connected to the casing 414 by a piston plate spring 410. The displacer 402 is so set as to reciprocate with phase difference of about 90° with respect to reciprocation of the piston 401 in the same cycle due to pressure change of the working gas in the working space 412 resulting from reciprocation of the piston 401.

A regenerator 404 is arranged outside the first cylinder 403 to enclose the same, and this regenerator 404 separates the expansion space 406 and the compression space 407 from each other. Further, internal heat exchangers 405*a* and 405*b* are arranged to enclose the first cylinder 403 through the regenerator 404. The working gas reciprocates between the expansion space 406 and the compression space 407 in response to reciprocation of the displacer 402. The working gas successively permeates the internal heat exchanger 405*a*, the regenerator 404 and the internal heat exchanger 405*b* when moving from the expansion space 406 to the compression space 407, and reversely permeates the same when moving backward.

The working gas is treated in the aforementioned manner thereby forming a reverse Stirling heat cycle in the working space 412 and obtaining a low temperature in the expansion space 406. The reverse Stirling heat cycle such as the principle of generation of a low temperature is a known technique, and hence description thereof is omitted.

In the aforementioned conventional Stirling refrigerator, the piston 401 may be hollowed in order to reduce a driving load or the material cost. Further, a gas bearing may be employed for attaining lubrication between the piston 401 and the second cylinder 415. As a structure simultaneously implementing both of these cases, therefore, the section of the piston 401 may conceivably be brought into a structure shown in FIG. 36. A hole connecting the internal space 421 and the compression space 407 with each other is provided on a surface of an outer shell 420 of the piston 401 facing the compression space 407, and a check valve 422 is provided for permitting the working gas passing through this hole to move toward the internal space 421 while inhibiting the same from moving toward the compression space 407. The working gas flowing into the internal space 421 through the check valve 422 effuses out from the piston 401 through a gas bearing hole 423 provided on a surface of the outer shell 420 sliding with the second cylinder 415 since the pressure in the internal space 421 is increased as the piston 401 progresses. Thus, the working gas effusing through the gas bearing hole 423 forms a gas bearing between the piston 401 and the second cylinder 415 for facilitating smooth reciprocation of the piston 401.

In the Stirling refrigerator comprising the aforementioned gas bearing, it follows that the working gas flows into the internal space 421 of the piston 401. In order to reduce the weight, on the other hand, the internal space 421 is desirably increased to the maximum in size. If the internal space 421 of the piston 401 has a large capacity, however, it follows that not only the compression space 407 but also the internal space 421 is compressed when the piston 401 moves toward the compression space 407. If the internal space 421 is wide, the quantity of work in compression is increased. Thus, energy lost as miscellaneous loss is increased.

An object of the first invention is to provide a Stirling engine enabling suppression of the problem described with reference to the first prior art, i.e., reduction of the performance of the Stirling engine or reduction of reliability resulting from clogging in the gas outlet.

The second invention has been proposed in consideration of the circumstances described with reference to the second prior art, and an object thereof is to provide a Stirling engine comprising a tapered surface partially or entirely on either one or both of a contact surface of a porous body with the peripheral wall of an effector and the inner surface of the peripheral wall of the effector and inserting a portion of the porous body having a small outer diameter from a portion of a pressurization chamber in the effector having a large inner diameter so that a load for reducing or enlarging the diameter is applied to the tapered surface, restoring force for enlarging or reducing the diameter is caused on the said tapered surface after insertion of the porous body into the pressurization chamber, and adhesion between the porous body and the peripheral wall of the effector is strong.

Another object of the second invention is to provide a Stirling engine comprising a constraint portion consisting of a viscous synthetic resin material on a contact surface of a porous body with a peripheral wall of an effector for constraining the porous body on the effector through the constraint portion so that the porous body does not move from a prescribed position due to the viscosity of the constraint portion.

Still another object of the second invention is to provide a Stirling engine provided with a constraint portion to enclose the peripheral edge of a through hole on the inner surface of a peripheral wall of an effector for constraining a porous body on the effector through the constraint portion thereby reducing gas flow loss from the outer peripheral portion of the porous body.

A further object of the second invention is to provide a Stirling engine having a porous body provided with a notched portion or a slit to be capable of changing the outer diameter of the porous body by reducing the width of the notched portion or the slit so that the porous body can be readily inserted into a pressurization chamber and restoring force for enlarging the width is caused on the notched portion or the slit after insertion of the porous body into the pressurization chamber thereby attaining strong adhesion between the porous body and the peripheral wall of the effector.

A further object of the second invention is to provide a Stirling engine having a pressurization chamber provided with a step portion and a porous body provided with a projection for stopping the projection by the step portion when inserting the porous body into the pressurization chamber thereby readily arranging the porous body on a prescribed position in the pressurization chamber.

A further object of the second invention is to provide a Stirling engine comprising step portions on two portions in a pressurization chamber through an open end of a through hole for bonding a porous body and the respective ones of the step portions provided on two portions thereby reducing effusion of gas from the outer peripheral portion of the porous body.

A further object of the second invention is to provide a Stirling engine having a porous body so fixed to a peripheral wall of an effector with a pin that the porous body does not move from a prescribed position.

A further object of the second invention is to provide a Stirling engine capable of reinforcing adhesion of a porous body to an effector by preparing the aforementioned porous body from a synthetic resin material while attaining weight reduction of a piston including the porous body and capable of damping vibration and noise in engine operation.

The third invention has been proposed in order to solve the problem described with reference to the third prior art, and an object thereof is to provide a Stirling engine attaining reduction of miscellaneous loss following gas flowage in the Stirling engine and miscellaneous loss following vibration of the Stirling engine itself.

SUMMARY OF THE INVENTION

According to an aspect of the Stirling engine based on the first invention, the Stirling engine comprises a gas bearing storing high-pressure gas generated by reciprocation of an effector arranged in a cylinder in a pressurization chamber provided in the aforementioned effector for effusing the aforementioned high-pressure gas in the aforementioned effector to a sliding part between the aforementioned cylinder and the aforementioned effector, while a first porous body is arranged upstream an effusion side for the aforementioned high-pressure gas and a second porous body smaller in porosity than the aforementioned first porous body is arranged downstream the effusion side for the aforementioned high-pressure gas in an outlet for the aforementioned high-pressure gas provided on a side wall portion of the aforementioned effector.

According to this structure, it is possible to obtain both characteristics of narrowing down the gas flow rate and inhibiting clogging, which have been hard to obtain solely in the conventional porous body, by effusing the gas through the first porous body and the second porous body thereby trapping large dust and narrowing down the gas in the first porous body and further narrowing down the gas in the second porous body. In the aforementioned invention, the aforementioned first porous body and the aforementioned second porous body are preferably stacked/arranged along the radial direction of the aforementioned cylinder in the aforementioned pressurization chamber.

In the aforementioned first invention, the aforementioned first porous body and the aforementioned second porous body are preferably stacked/arranged along the axial direction of the aforementioned cylinder in the aforementioned pressurization chamber. Thus, the porous bodies are arranged in a line in the axial direction, whereby the outer diametral dimensions and the inner diametral dimensions of the first porous body and the second porous body can be equalized with each other so that the porous bodies can be manufactured in the same mold in preparation thereof.

The aforementioned first porous body and the aforementioned second porous body are stacked/arranged along the radial direction of the aforementioned cylinder in a hole provided in a side wall portion of the aforementioned effector toward the radial direction.

This structure is so employed that assembling operation can be efficiently performed without requiring a jig since the same can be implemented by simply inserting the first porous body and the second porous body into the hole.

In the aforementioned first invention, at least either one of the aforementioned first porous body and the aforementioned second porous body is preferably made of resin. The weight of the Stirling engine can be reduced by employing this structure. Further, vibration or a noise level can also be reduced.

According to another aspect of the Stirling engine based on the first invention, the Stirling engine comprises a gas bearing storing high-pressure gas generated by reciprocation of an effector arranged in a cylinder in a pressurization chamber provided in the aforementioned effector for effusing the aforementioned high-pressure gas in the aforementioned effector to a sliding part between the aforementioned cylinder and the aforementioned effector, while a region of the aforementioned effector including a sliding surface with the aforementioned cylinder and the aforementioned pressurization chamber is formed by a porous body.

Thus, the effector is so formed by the porous body that a step of assembling one of two types of porous bodies can be omitted when compared with the structure of the aforementioned invention, whereby the cost can be reduced.

In each of the aforementioned inventions, the aforementioned effector is a piston or a displacer.

A Stirling engine according to one aspect of the second invention is characterized in that a Stirling engine storing high-pressure gas generated by reciprocation of an effector slidably arranged in a cylinder in a pressurization chamber provided in the effector for injecting the high-pressure gas in this pressurization chamber through a porous body provided inside a peripheral wall of the effector from a through hole provided in the peripheral wall to a sliding part between the effector and the cylinder comprises a tapered surface partially or entirely on either one or both of a contact surface of the porous body with the peripheral wall of the effector and the inner surface of the peripheral wall of the effector.

According to the aforementioned structure, the porous body has a tapered surface and this porous body is inserted into the pressurization chamber in the effector from a portion having a small outer diameter so that a load for reducing the diameter is applied to the tapered surface thereby causing restoring force for enlarging the diameter on the tapered surface after insertion of the porous body into the pressurization chamber, whereby adhesion between the porous body and the effector is strengthened. The inner side of the peripheral wall of the effector has a tapered surface and the porous body is inserted from a portion of the pressurization chamber having a large inner diameter so that a load for enlarging the diameter is applied to the tapered surface and restoring force for reducing the diameter is caused on the tapered surface after insertion into the pressurization chamber, whereby the adhesion between the porous body and the effector is strengthened. Therefore, the porous body does not move from a prescribed position during engine operation either so that a gas passage can be stabilized and the effector can stably reciprocate by uniformizing the quantities of the gas injected from respective gas outlets.

A Stirling engine according to another aspect of the second invention is characterized in that, in a Stirling storing high-pressure gas generated by reciprocation of an effector slidably arranged in a cylinder in a pressurization chamber provided in the effector for injecting the high-pressure gas in this pressurization chamber through a porous body provided inside a peripheral wall of the effector from a through hole provided in the peripheral wall to a sliding part between the effector and the cylinder, the porous body includes a constraint portion consisting of a viscous synthetic resin material to be constrained on the peripheral wall partially or entirely on a contact surface with the peripheral wall of the effector.

According to the aforementioned structure, the constraint portion has viscosity and the porous body is so arranged in the pressurization chamber in the effector through the constraint portion that viscosity of the constraint portion increases constraining force between the porous body and the effector. Therefore, the porous body does not move from a prescribed position during engine operation either, a gas passage can be stabilized and the effector can stably reciprocate by uniformizing the quantities of the gas injected from respective gas outlets.

In the aforementioned second invention, the Stirling engine is preferably characterized in that the constraint portion is provided on the inner surface of the peripheral wall of the effector to enclose the peripheral edge of the through hole.

According to the aforementioned structure, the constraint portion is provided to enclose the peripheral edge of the through hole and the porous body is constrained on the effector through the constraint portion, whereby gas injection loss from the outer peripheral portion of the porous body can be reduced. Thus, the gas passage can be stabilized and the effector can stably reciprocate by uniformizing the quantities of the gas injected from the respective gas outlets.

A Stirling engine according to still another aspect of the second invention is characterized in that, in a Stirling engine storing high-pressure gas generated by reciprocation of an effector slidably arranged in a cylinder in a pressurization chamber provided in the effector for injecting the high-pressure gas in this pressurization chamber through a porous body provided inside a peripheral wall of the effector from a through hole provided in the peripheral wall to a sliding part between the said effector and the said cylinder, the said porous body is an annular body partially notched in the circumferential direction.

In the aforementioned second invention, the Stirling engine is preferably characterized in that the porous body has a notched portion arranged on a surface, excluding an open end of the through hole, of the inner surface of the peripheral wall of the effector.

A Stirling engine according to a further aspect of the second invention is characterized in that in a Stirling engine storing high-pressure gas generated by reciprocation of an effector slidably arranged in a cylinder in a pressurization chamber provided in said effector for injecting the high-pressure gas in this pressurization chamber through a porous body provided inside a peripheral wall of the effector from a through hole provided in the peripheral wall to a sliding part between the effector and the cylinder, the porous body is an annular body having an axial slit on the outer peripheral surface.

According to the aforementioned structure, insertion of the porous body into the pressurization chamber is simplified by reducing the width of the notched portion or the slit thereby changing the outer diameter of the porous body. After insertion of the porous body into the pressurization chamber, restoring force for enlarging the width is caused on the notched portion or the slit, whereby adhesion between the porous body and the peripheral wall of the effector is strengthened. Therefore, the porous body does not move from a prescribed position during engine operation either, a gas passage can be stabilized and the effector can stably reciprocate by uniformizing the quantities of the gas injected from respective gas outlets.

A Stirling engine according to a further aspect of the second invention is characterized in that in a Stirling engine storing high-pressure gas generated by reciprocation of an effector slidably arranged in a cylinder in a pressurization chamber provided in the effector for injecting the high-pressure gas in this pressurization chamber through a porous body provided inside a peripheral wall of the effector from a through hole provided in the peripheral wall to a sliding part between the effector and the cylinder, the pressurization chamber has a step portion perpendicular to the direction of motion of the effector and the porous body has a projection to be stopped by the step portion.

According to the aforementioned structure, the projection provided on the porous body is stopped by the step portion in the pressurization chamber when the porous body is inserted into the pressurization chamber, whereby the porous body can be readily arranged on a prescribed position in the pressurization chamber.

In the aforementioned second invention, the Stirling engine is preferably characterized in that the pressurization chamber is provided with step portions on two portions through an open end of the through hole.

According to the aforementioned structure, the pressurization chamber comprises the step portions on two portions through the open end of the through hole and the porous body is bonded to each step portion, whereby the bonded surface reduces injection loss of the gas. The passage of the gas is stabilized due to reduction of flow loss of the gas, and the effector can stably reciprocate by uniformizing the quantities of the gas injected from respective gas outlets.

A Stirling engine according to a further aspect of the second invention is characterized in that in a Stirling engine storing high-pressure gas generated by reciprocation of an effector slidably arranged in a cylinder in a pressurization chamber provided in the effector for injecting the high-pressure gas in this pressurization chamber through a porous body provided inside a peripheral wall of the effector from a through hole provided in the peripheral wall to a sliding part between the effector and the cylinder, the porous body is fixed to the peripheral wall of the effector with a pin.

According to the aforementioned structure, the porous body is fixed to the peripheral wall of the effector with the pin, whereby the porous body does not move from a prescribed position. Therefore, the passage of the gas can be stabilized and the effector can stably reciprocate by uniformizing the quantities of the gas injected from respective gas outlets.

In the aforementioned second invention, the Stirling engine is preferably characterized in that the porous body consists of a synthetic resin material.

According to the aforementioned structure, adhesion of the porous body to the effector can be reinforced by preparing the porous body from the synthetic resin material. Therefore, the porous body does not move from the prescribed position during engine operation either, the passage of the gas can be stabilized and the effector can stably reciprocate by uniformizing the quantities of the gas injected from respective gas outlets. Further, the weight of the piston is so reduced that vibration and noise can be reduced in engine operation.

A Stirling engine according to an aspect of the third invention comprises a piston engaged in a cylinder and driven by driving means to reciprocate and a displacer engaged in the cylinder for receiving force resulting from reciprocation of the piston and reciprocating with difference in phase from the piston, and further comprises a compression chamber sectionally formed between the piston and the displacer, a back pressure chamber positioned oppositely to the compression chamber through the piston and formed to include at least part of the outer wall of the cylinder as its wall surface, a communication path consisting of a first communication passage formed in the piston and a second communication passage provided on the side wall of the cylinder for connecting the pressure chamber and the back pressure chamber with each other and gas flow control means controlling the flow rate of gas circulating through the communication path.

According to the aforementioned structure, the flow rate of the gas circulating through the communication path can be freely controlled due to the provision of the gas flow control means and it is possible to provide a Stirling engine having high efficiency reduced in miscellaneous loss.

In the Stirling engine according to the aforementioned third invention, the flow control means is preferably formed by a member inserted in the first communication passage for reducing the sectional area of this first communication passage, for example.

According to the gas flow control means having the aforementioned structure, the flow rate of the gas circulating through the communication path can be readily and simply controlled to the optimum rate without re-manufacturing the piston also when the optimum gas flow rate is reduced due to specification change. Thus, the manufacturing cost is prevented from increase resulting from specification change, and a low-priced Stirling engine can be provided.

In the Stirling engine according to the aforementioned third invention, the member controlling the flow rate of the gas is preferably a bar member having elastic force coming into contact with the wall surface of the first communication passage on at least two positions thereby pressing the wall surface of the first communication passage, and is held in the first communication passage.

According to the aforementioned structure, the bar member having elastic force is so employed as the member controlling the flow rate of the gas that the bar member is spring-fitted with the wall surface of the first communication passage and fixed, not to escape by reciprocation of the piston. Further, mounting operation is simplified due to the spring fitting, so that a load on an operator is reduced and the manufacturing cost is also reduced.

In the Stirling engine according to the aforementioned third invention, the flow control means preferably includes valve means controlling the opening area of the second communication passage, for example.

According to the aforementioned structure, the opening area of the second communication passage can be controlled with the valve means in conformity to the optimum gas flow rate changing from moment to moment in response to the operational situation of the Stirling engine, for controlling the same to a gas flow rate closer to the optimum value. Therefore, it is possible to provide a Stirling engine remarkably improved in efficiency. It is also possible to regularly maintain the optimum gas flow rate by separately providing a function of calculating the optimum value of the opening area at the instant so that the valve means optimally controls the opening area in association with this calculated value.

In the Stirling engine according to the aforementioned third invention, the valve means preferably includes a bar member having a section gradually reduced toward the forward end, for reducing the opening area of the second communication passage by inserting the forward end of the bar member into the second communication passage, for example.

According to the aforementioned structure, the gas flow rate can be controlled to a value closer to the optimum value by varying the forward end position of the bar member with the optimum gas flow rate changing from moment to moment in response to the operational situation of the Stirling engine.

A Stirling engine according to another aspect of the third invention comprises a piston engaged in a cylinder and driven by driving means to reciprocate, a displacer engaged in the cylinder for receiving force resulting from reciprocation of the piston and reciprocating with difference in phase from the piston, a casing holding/fixing the cylinder and a dynamic vibration damping mechanism absorbing vibration of the casing resulting from reciprocation of the piston and the displacer, while the dynamic vibration damping mechanism includes a mass part vibrating with difference in phase from vibration of the casing thereby absorbing the vibration of the casing and an elastic part coupling the mass part and the casing with each other for producing the phase difference, and the mass part includes a through hole in its vibrational direction.

According to the aforementioned structure, the mass part of the dynamic vibration damping mechanism has the through hole in the same direction as its vibrational direction, whereby air resistance against vibration of the mass part is reduced and motion loss of the mass part is reduced. Thus, miscellaneous loss of the Stirling engine is also reduced so that the Stirling engine is improved in efficiency.

A Stirling engine according to still another aspect of the third invention comprises a piston engaged in a cylinder and driven by driving means to reciprocate, a displacer engaged in the cylinder for receiving force resulting from reciprocation of the piston and reciprocating with difference in phase from the piston, a casing holding/fixing the cylinder and a dynamic vibration damping mechanism mounted on the casing for absorbing vibration of the casing resulting from reciprocation of the piston and the displacer, and the Stirling engine further comprises a vacuum vessel mounted on the casing to include the dynamic vibration damping mechanism, while the dynamic vibration damping mechanism includes a mass part vibrating with difference in phase from vibration of the casing thereby absorbing the vibration of the casing and an elastic part coupling the mass part and the casing with each other for producing the phase difference.

According to the aforementioned structure, the dynamic vibration damping mechanism is so arranged in the vacuum vessel as to eliminate air resistance against vibration of the mass part thereof, whereby motion loss caused by the dynamic vibration damping mechanism can be completely eliminated. Thus, miscellaneous loss of the Stirling engine is also reduced so that the Stirling engine is improved in efficiency.

In order to attain the aforementioned object, the Stirling refrigerator based on the fourth invention comprises a working space, filled up with working gas, including an expansion space and a compression space, a cylinder fixed in the aforementioned working space, a displacer reciprocative in the aforementioned cylinder in a direction connecting the aforementioned expansion space side and the aforementioned compression space side with each other, a piston reciprocative to compress and expand the aforementioned compression space and a regenerator, separating the aforementioned expansion space and the aforementioned compression space from each other outside the aforementioned cylinder, permeable to the aforementioned working gas, while the aforementioned piston includes an outer shell including an internal space communicating with the aforementioned working space inside, a check valve for rendering the aforementioned working gas movable only from the aforementioned compression space only toward the aforementioned internal space, a gas bearing for smoothing the aforementioned reciprocation of the aforementioned piston by injecting the aforementioned working gas in the aforementioned internal space from a hole provided in the aforementioned outer shell outward from the aforementioned outer shell and a lightweight internal member, arranged in the aforementioned internal space, which is a member containing a material smaller in specific gravity than a material forming the aforementioned outer shell.

The lightweight internal member is arranged in the internal space to block the space thereby reducing the capacity of the internal space due to employment of the aforementioned structure, whereby the volume of a compressed region can be inhibited from increase also when the compression space and the internal space communicate with each other through the check valve when the compression space is compressed. Consequently, the quantity of compression work can be inhibited from increase so that the quantity of miscellaneous loss of the Stirling refrigerator can be inhibited from increase.

In the aforementioned fourth invention, the aforementioned lightweight internal member preferably contains either plastic or rubber. The capacity of the internal space can be reduced while keeping the outer shell 0 thin and keeping the internal space large due to employment of this structure. Further, the manufacturing cost can also be inhibited from increase.

In the aforementioned fourth invention, the specific heat of the aforementioned lightweight internal member is preferably at least 1 kJ/kg·K. The lightweight internal member serves to buffer heat conduction between a low temperature on the working space side and a relatively high temperature on the driving space side due to employment of this structure. Therefore, it is possible to prevent low-temperature working gas, flowing from the compression space into the internal space, from abrupt expansion resulting from temperature increase. Further, the capacity of the internal space is reduced due to arrangement of the lightweight internal member. Consequently, the quantity of miscellaneous loss can be reduced.

In the aforementioned fourth invention, the aforementioned lightweight internal member is preferably of either polyester fiber or absorbent cotton. A lightweight internal member of a material having specific heat of at least 1 kJ/kg·K and smaller specific gravity than the material for the outer shell can be implemented and is easy to manufacture due to employment of this structure. Further, the cost can also be suppressed.

In the aforementioned fourth invention, the aforementioned lightweight internal member preferably includes interference avoidance means for avoiding interference with the aforementioned check valve. The lightweight internal member can be prevented from hindering operation of the check valve by moving or spreading in the internal space due to employment of this structure.

In the aforementioned fourth invention, the aforementioned piston is preferably circumferentially provided with a groove on the outer surface of the aforementioned outer shell. A sealing effect is so brought that the working gas can be prevented from leaking toward the driving space side due to employment of this structure. The working gas can be so prevented from leakage that leakage loss can be reduced, whereby the quantity of compression work of the piston can be prevented from increase. Consequently, the quantity of miscellaneous loss can be further inhibited from increase in addition to the effect of suppressing increase of the quantity of miscellaneous loss according to each of the aforementioned inventions.

In the aforementioned fourth invention, the Stirling refrigerator preferably comprises a working space, filled up with working gas, including an expansion space and a compression space, a cylinder fixed in the aforementioned working space, a displacer reciprocative in the aforementioned cylinder in a direction connecting the aforementioned expansion space side and the aforementioned compression space side with each other, a piston reciprocative to compress and expand the aforementioned compression space and a regenerator, separating the aforementioned expansion space and the aforementioned compression space from each other outside the aforementioned cylinder, permeable to the aforementioned working gas, while the aforementioned piston includes an outer shell including an internal space communicating with the aforementioned working space inside, a check valve so provided that the aforementioned working gas is movable from the aforementioned compression space toward the aforementioned internal space but not oppositely movable and a gas bearing for smoothing the aforementioned reciprocation of the aforementioned piston by injecting the aforementioned working gas in the aforementioned internal space from a hole provided in the aforementioned outer shell outward from said outer shell, and the aforementioned piston has a groove on the outer surface of the aforementioned outer shell in an enclosing manner. A sealing effect is so brought that the working gas can be prevented from leaking toward the driving space side due to employment of this structure. The working gas can be so prevented from leakage that leakage loss can be reduced, whereby the quantity of compression work of the piston can be prevented from increase and the quantity of miscellaneous loss of the Stirling refrigerator can be inhibited from increase.

DESCRIPTION OF THE INVENTION (First Embodiment)

Figure 1:
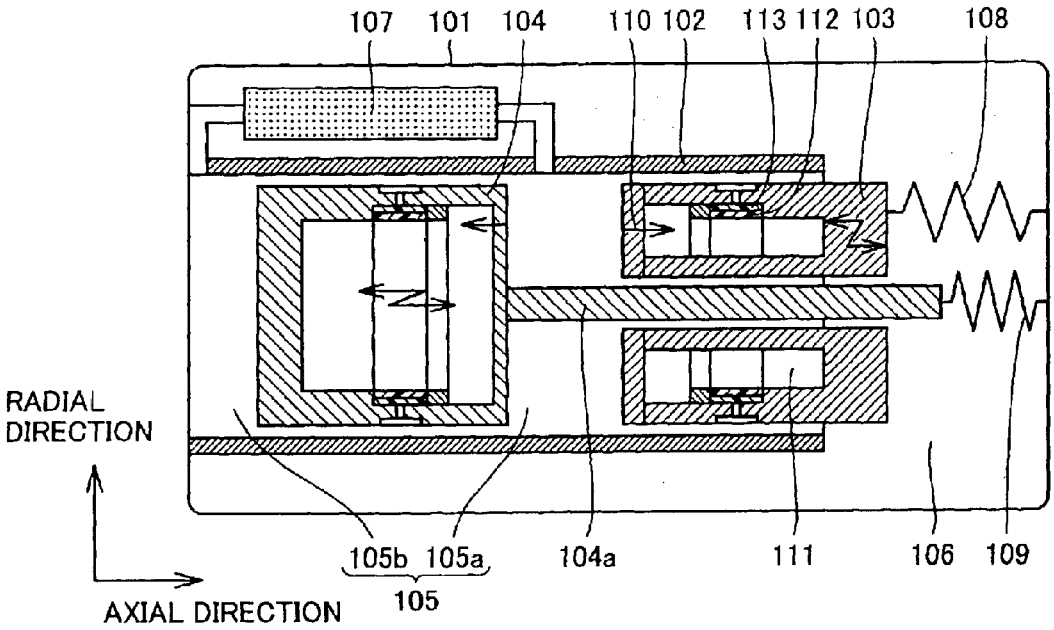
FIG. 1 is a diagram schematically showing the structure of a Stirling engine according to a first embodiment based on the present invention.

A Stirling engine according to a first embodiment based on the present invention is now described with reference to the drawings.

(Schematic Structure of Stirling Engine)

The structure of a Stirling engine according to this embodiment is schematically described with reference to FIG. 1. In this embodiment, a pressure vessel 101 is filled up with high-pressure helium gas (hereinafter simply referred to as "gas") as a medium. A piston 103 and a displacer 104 serving as effectors are arranged in a single cylinder 102, so that the piston 103 and the displacer 104 reciprocate respectively.

The piston 103 divides a space formed by the pressure vessel 102 and the cylinder 102 into two spaces. The first space is a working space 105 defined on a side of the piston 103 closer to the displacer 104. The second space is a back space 106 defined on a side of the piston 103 opposite to the displacer 104.

The displacer 104 further divides the working space 105 which is the first space into two spaces. The first divided space is a compression space 105*a* consisting of a region held between the piston 103 and the displacer 104. The second divided space is an expansion space 105*b* consisting of a region on the forward end of the cylinder 102. The compression space 105*a* and the expansion space 105*b* are coupled with each other through a regenerator 107.

The back space 106 is formed by the pressure vessel 101 to enclose the cylinder 102. Pressures in the compression space 105*a* and the expansion space 105*b* vary in correspondence to displacement of the reciprocation of the piston 103 with reference to the pressure of the gas filling up the pressure vessel 101.

A piston spring 108 supports the piston 103 with respect to the pressure vessel 101. The piston 103 is linearly driven by a piston driver (not shown) consisting of a linear motor or the like in the axial direction of the pressure vessel 101 and reciprocates in the cylinder 102 for compressing and expanding the gas.

The displacer 104 includes a through axial part 104*a* passing through the piston 103, and a displacer spring 109 supports this through axial part 104*a* with respect to the pressure vessel 101. The displacer 104 reciprocates through a resonance effect of the displacer spring 109. Consequently, the gas in the working space 105 reciprocates between the compression space 105*a* and the expansion space 105*b*.

The gas compressed in the compression space 105*a* due to the reciprocation of the piston 103 flows into a pressurization chamber 111 in the piston 103 through a one-way valve 110 provided on the piston 103 thereby maintaining a high pressure state in the pressurization chamber 111. The gas flows out from the pressurization chamber 111 into a sliding part between the piston 103 and the cylinder 102 and forms a hydrostatic gas bearing by a gas bearing effect so that the piston 103 is reciprocative in a non-contact state with respect to the cylinder 102.

In this embodiment, the quantity of the gas flowing out from the pressurization chamber 111 toward the sliding part is narrowed down due to employment of a structure described later, whereby the pressurization chamber 111 stores a gas pressure substantially equal to the maximum pressure in gas pressure fluctuation in the compression space 105*a* substantially with no gas flow loss.

For example, the gas pressure in the pressurization chamber 111, varying with operational conditions, is substantially equivalent to the maximum pressure in gas pressure fluctuation in the compression space 105*a*, such that the gas pressure in the pressurization chamber 111 is about 2.7 MPa when the filler gas pressure in the Stirling engine is about 2.5 MPa.

A Stirling cycle employing the structure shown in FIG. 1 is well known in general, and hence detailed description thereof is omitted.

(Structure of Gas Effusion Part)

Figure 2:
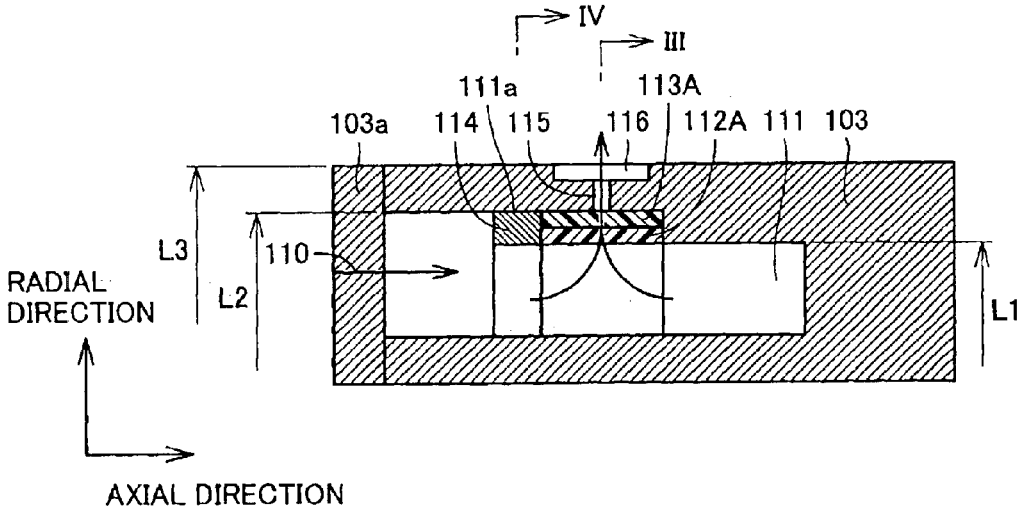
FIG. 2 is a diagram showing the sectional form of a piston in the first embodiment based on the present invention.
Figure 3:
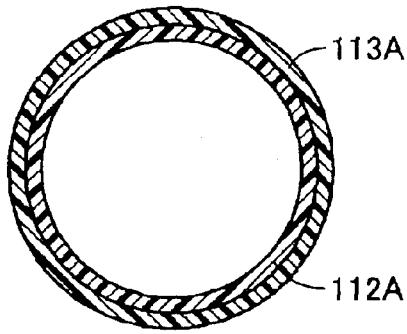
FIG. 3 is a sectional view taken along the line III in FIG. 2.
Figure 4:
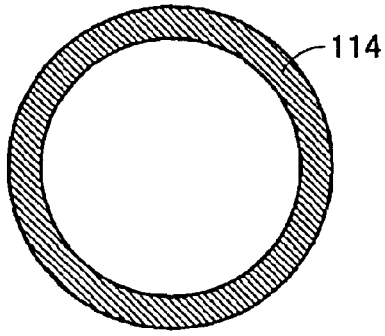
FIG. 4 is a sectional view taken along the line IV in FIG. 2.

The structure of a gas effusion part in this embodiment is described with reference to FIGS. 2 to 4. The piston 103 has a symmetrical form about the axis of the cylinder 102, and hence it is assumed that the figures illustrate only the sectional form on the upper side of the piston 103 shown in FIG. 1 (this is also assumed in each embodiment described below). FIG. 2 is a diagram showing the sectional form of the piston 103, FIG. 3 is a sectional view taken along the line III in FIG. 2 and FIG. 4 is a sectional view taken along the line IV in FIG. 2.

Referring to FIG. 2, the piston 103 is provided with a plurality of gas outlets (e.g., on four positions at a 90° pitch) each consisting of a vent hole 115 and a pocket 116 on its circumference. The vent hole 115 consists of a small hole of ϕ0.5 mm, and the pocket 116 has a concave shape of ϕ8 mm having a depth of 1.0 mm.

In the pressurization chamber 111 inside the gas outlets, a first porous body 112A having large capacity and a second porous body 113A are stacked and arranged along the diametral direction of the cylinder 102 to be arranged upstream the gas flow direction and downstream the gas flow direction respectively. It is assumed that the porosity indicates the ratio occupied by the total volume of holes per unit volume. The diametral direction of the cylinder 102 denotes the direction along the radial direction of the cylinder 102, as shown in FIG. 1.

A ring 114 is provided for fixing the first porous body 112A and the second porous body 113A in the pressurization chamber 111. Inner diametral dimensions L1 and L2 in the pressurization chamber 111 are ϕ20 mm and ϕ25 mm respectively. The outer diameter L3 of the piston 103 is ϕ32 mm.

The first porous body 112A and the second porous body 113A have doughnut forms, as shown in FIG. 3. The first porous body 112A is dimensionally ϕ22 mm in outer diameter and ϕ20 mm in inner diameter, and polyethylene of 60% in porosity is employed as the material therefor. The second porous body 113A is dimensionally ϕ25 mm in outer diameter and ϕ22 mm in inner diameter, and polyethylene of 30% in porosity is employed as the material therefor.

As to insertion of the first porous body 112A, the second porous body 113A and the ring 114 into the pressurization chamber 111, an openable/closable lid body 103*a* is provided on the bottom of the piston 103 for employing a structure of locating the first porous body 112A, the second porous body 113A and the ring 114 on prescribed positions in the pressurization chamber 111 and thereafter closing the bottom of the piston 103 with the lid body 103*a*.

In order to assemble the first porous body 112A and the second porous body 113A into the piston 103, the cylindrical second porous body 113A is first press-fitted into the piston 103. The pressurization chamber 111 is provided therein with a step portion 111*a* for assembling the porous body, thereby deciding the axial position of the porous body. The axial direction denotes a direction along the axial direction of the cylinder 103, as shown in the figures.

Then, the first porous body 112A is press-fitted into the inner peripheral portion of the second porous body 113A. Thereafter the ring 114 is inserted into the ends of the bottom surfaces of the first porous body 112A and the second porous body 113A. Thus, gas inflow from the ends of the porous bodies can be blocked by providing the ring 114 so that the gas inlet passage can be singularized and the gas flow rate can be stabilized.

An equivalent effect can be attained also when performing blinding treatment of closing pores of the porous bodies on the ends of the first porous body 112A and the second porous body 113A in place of insertion of the ring 114. As to the blinding treatment, a method of breaking holes of the porous bodies by performing machining with a lathe or a method of winding resin films on inner peripheral surface portions of the porous bodies and sintering the porous bodies thereby breaking holes of the porous bodies when preparing the porous bodies in molds can be listed.

Clamp margins for the inner peripheral surface of the pressurization chamber 111 and the second porous body 113A and clamp margins for the first porous body 112A and the second porous body 113A remarkably influence the quantity of gas loss. These clamp margins must be set to dimensions allowing sufficient clamping without damaging the first porous body 112A and the second porous body 113A. In this embodiment, the clamp margins in the respective diametral directions are set to about 0.1 mm.

In the gas outlet port consisting of the aforementioned structure, the gas stored in the pressurization chamber 111 passes through the first porous body 112A and the second porous body 113A and flows out to the sliding part between the piston 103 and the cylinder 102 through the vent holes 115 provided in the piston 103. The outflow of the gas is about 60 ml/min. at this time.

(Function/Effect)

In the aforementioned structure of the gas effusion part applied to the Stirling engine according to this embodiment, a porous body having large porosity is employed for the first porous body 112A thereby trapping large dust caused during operation while narrowing down the gas effusion. A porous body having small porosity is employed for the second porous body 113A, thereby further narrowing down the gas effusion.

Thus, the gas flows out through the first porous body 112A and the second porous body 113A so that the first porous body 112A traps large dust while narrowing down the gas and the second porous body 113A further narrows down the gas, whereby it is possible to obtain both characteristics of narrowing down the gas flow rate, which has been hard to attain solely in the conventional single porous body, and inhibiting blinding.

While the case of employing the two-layer structure of the first porous body 112A and the second porous body 113A has been described, a similar function/effect can be attained also when employing such a multilayer structure that porosity of a porous body is gradually reduced outward from inside.

While the structure of the gas effusion part provided on the piston 103 has been described in the aforementioned embodiment, a gas effusion part of the same structure can be employed also on the side of the displacer 104 shown in FIG. 1.

(Second Embodiment)

A Stirling engine according to a second embodiment based on the present invention is now described with reference to the drawings. As to structures identical to those in the first embodiment, detailed description is omitted. The feature of the Stirling engine according to this embodiment resides in the structure of a gas effusion part provided on a piston, and hence only the structure of this gas effusion part is mentioned here.

Figure 5:
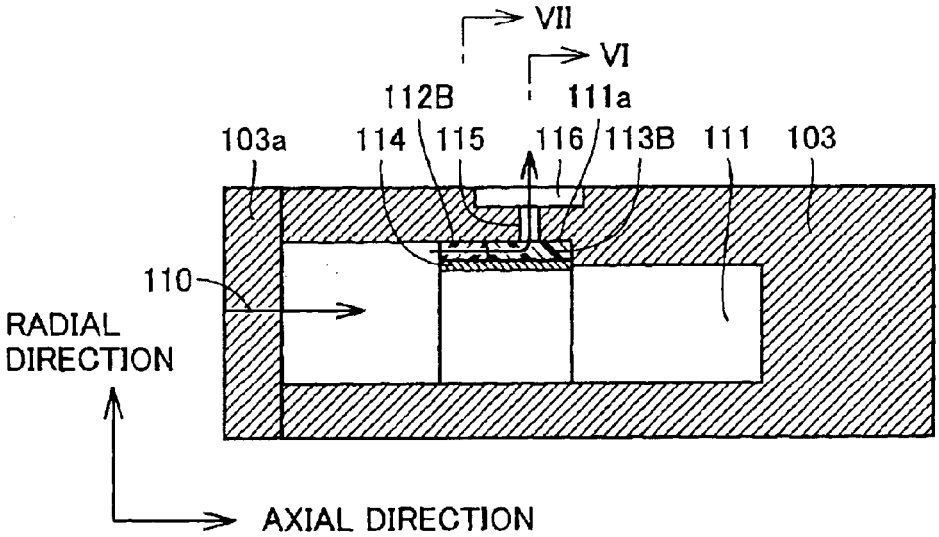
FIG. 5 is a diagram showing the sectional form of a piston in a second embodiment based on the present invention.
Figure 6:
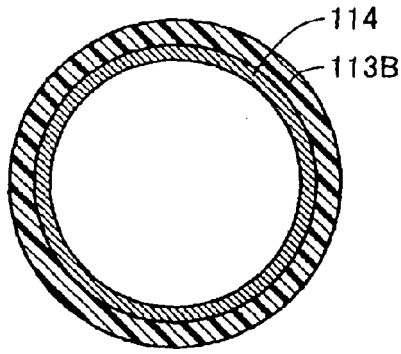
FIG. 6 is a sectional view taken along the line VI in FIG. 5.
Figure 7:
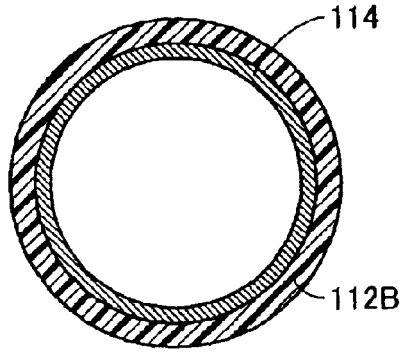
FIG. 7 is a sectional view taken along the line VII in FIG. 5.

The structure of the gas effusion part in this embodiment is described with reference to FIGS. 5 to 7. FIG. 5 is a diagram showing the sectional form of a piston 103, FIG. 6 is a sectional view taken along the line VI in FIG. 5, and FIG. 7 is a sectional view taken along the line VII in FIG. 5.

Referring to FIG. 5, a first porous body 112B having large porosity and a second porous body 113B having small porosity are continuously arranged along the axial direction of a cylinder 102 to be arranged upstream a gas flow direction and downstream the gas flow direction respectively, and a ring 114 is inserted into the first porous body 112B and the second porous body 113B. As to a gas passage, therefore, gas axially flows with respect to the porous bodies as shown by arrow in FIG. 5. It is possible to trap large dust and narrow down the gas in the first porous body 112B while narrowing down the gas in the second porous body 113B by taking such a gas flow rate.

Similarly to the case of the aforementioned first embodiment, inner diametral dimensions L1 and L2 in a pressurization chamber 111 are ϕ20 mm and ϕ25 mm respectively. The outer diameter L3 of the piston 103 is ϕ32 mm. The first porous body 112B and the second porous body 113B have doughnut forms, as shown in FIGS. 6 and 7. Both of the first porous body 112B and the second porous body 113B are dimensionally ϕ25 mm in outer diameter and ϕ22 mm in inner diameter, while polyethylene of 60% in porosity is employed for the first porous body 112B and polyethylene of 30% in porosity is employed for the second porous body 113B as materials therefor.

In order to assemble the first porous body 112B and the second porous body 113B into the piston 103, the cylindrical second porous body 113B is first press-fitted up to a step portion 111*a* provided in the pressurization chamber 111. Then, the first porous body 112B is press-fitted to come into contact with the second porous body 113B. Thereafter the ring 114 is finally press-fitted into the inner peripheral surfaces of the porous bodies 112B and 113B, whereby porous bodies different in porosity from each other can be readily obtained.

Clamp margins for the inner peripheral surface of the pressurization chamber 111 and the second porous body 113B and clamp margins for the inner peripheral surface of the pressurization chamber 111 and the first porous body 112B remarkably influence the quantity of gas loss. These clamp margins must be set to dimensions allowing sufficient clamping without damaging the first porous body 112B and the second porous body 113B. In this embodiment, the clamp margins in the respective diametral directions are set to about 0.1 mm.

While the ring 114 is inserted into the inner surfaces of the first porous body 112B and the second porous body 113B after inserting the first porous body 112B and the second porous body 113B thereby enabling the gas flow rate shown by arrow in FIG. 5 in the description of FIG. 5, a similar effect can be attained also by performing blinding treatment (treatment similar to that in the case of the first embodiment) on the inner peripheral surfaces of the first porous body 112B and the second porous body 113B in place of this structure.

(Function/Effect)

Thus, the gas flows out through the first porous body 112B and the second porous body 113B, whereby a function/effect similar to that of the aforementioned first embodiment can be attained. In this embodiment, the porous bodies are arranged in line along the axial direction, whereby the outer diametral dimensions and the inner diametral dimensions of the first porous body 112B and the second porous body 113B can be equalized with each other so that the porous bodies can be manufactured through the same mold in preparation thereof.

While the case of employing the two-layer structure of the first porous body 112B and the second porous body 113B has been described, a similar function/effect can be attained also when employing such a multilayer structure that porosity of a porous body is gradually reduced toward vent holes 115 in the axial direction.

While the structure of the gas effusion part provided on the piston 103 has been described in the aforementioned embodiment, a gas effusion part of the same structure can be employed also on the side of a displacer 104 similarly to the case of the first embodiment.

(Third Embodiment)

A Stirling engine according to a third embodiment based on the present invention is now described with reference to the drawings. As to structures identical to those in the first embodiment, detailed description is omitted. The feature of the Stirling engine according to this embodiment resides in the structure of a gas effusion part provided on a piston, and hence only the structure of this gas effusion part is mentioned here.

Figure 8:
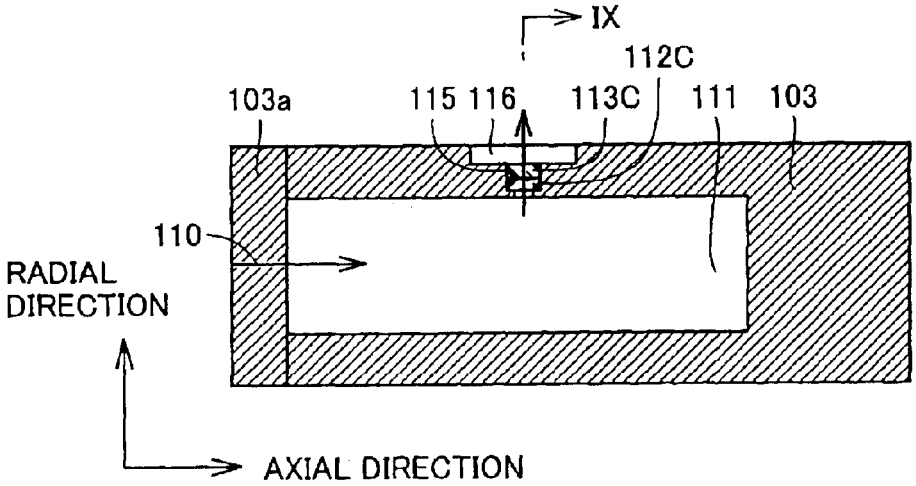
FIG. 8 is a diagram showing the sectional form of a piston in a third embodiment based on the present invention.
Figure 9:
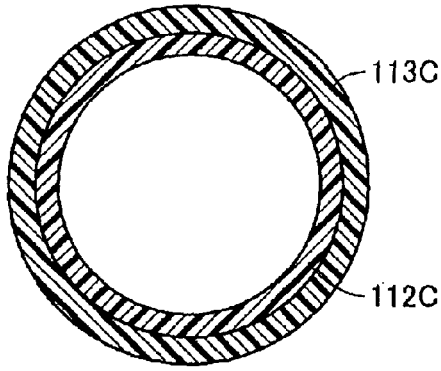
FIG. 9 is a sectional view taken along the line IX in FIG. 8.

The structure of the gas effusion part in this embodiment is described with reference to FIGS. 8 and 9. FIG. 8 is a diagram showing the sectional form of a piston 103, and FIG. 9 is a sectional view taken along the line IX in FIG. 8.

Referring to FIG. 8, a vent hole 115 is provided perpendicularly (along the diametral direction of a cylinder 102) toward a pressurization chamber 111 in the piston 103, while a first porous body 112C is arranged upstream a gas flow direction and a second porous body 113C is inserted to be arranged downstream the gas flow direction in this vent hole 115. Polyethylene of 60% in porosity is employed for the first porous body 112C and polyethylene of 30% in porosity is employed for the second porous body 113C as the materials therefor.

Gas stored in the pressurization chamber 111 passes through the first porous body 112C and the second porous body 113C and flows out to a sliding part between the piston 103 and the cylinder 102. The first porous body 112C having large porosity traps dust while narrowing down the gas flow rate, and the second porous body 113C having small porosity further narrows down the gas.

In order to assemble the porous bodies into the piston 103, the cylindrical first porous body 112C is first press-fitted into the vent hole 115 provided toward the pressurization chamber 111 from outside the piston 103. Then, the second porous body 113C is press-fitted to come into contact with the first porous body 112C, whereby porous bodies different in porosity from each other can be readily obtained.

(Function/Effect)

Thus, the gas flows out through the first porous body 112C and the second porous body 113C, whereby a function/effect similar to that of the aforementioned first embodiment can be attained. While a jig for inserting the porous bodies into the piston has been necessary in each of the aforementioned embodiments, efficiency of assembling operation can be improved in the structure of this embodiment since this can be implemented by merely inserting the first porous body 112C and the second porous body 113C into the vent hole 115.

While the case of employing the two-layer structure of the first porous body 112C and the second porous body 113C has been described, a similar function/effect can be attained also when employing such a multilayer structure that porosity of a porous body is gradually reduced outwardly toward the vent hole 115.

While the structure of the gas effusion part provided on the piston 103 has been described in the aforementioned embodiment, a gas effusion part of the same structure can be employed also on the side of a displacer 104 similarly to the case of the first embodiment.

(Fourth Embodiment)

A Stirling engine according to a fourth embodiment based on the present invention is now described with reference to the drawings. As to structures identical to those in the first embodiment, detailed description is omitted. The feature of the Stirling engine according to this embodiment resides in the structure of a gas effusion part provided on a piston, and hence only the structure of this gas effusion part is mentioned here.

Figure 10:
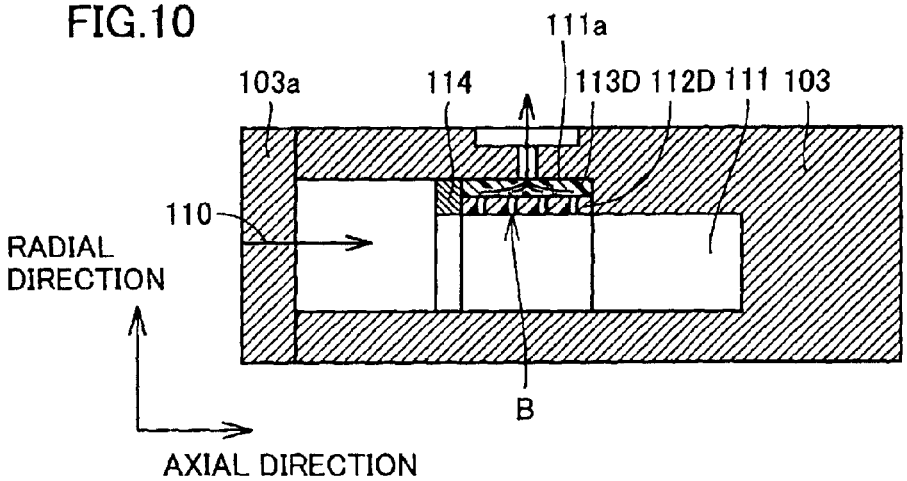
FIG. 10 is a diagram showing the sectional form of a piston in a fourth embodiment based on the present invention.

The structure of the gas effusion part in this embodiment is described with reference to FIG. 10. FIG. 10 is a diagram showing the sectional form of a piston 103.

Referring to FIG. 10, a second porous body 113D of resin is arranged on a step portion 111*a* in the piston 103 while a first porous body 112D is arranged on the inner surface thereof, similarly to the structure shown in the first embodiment. As viewed from a gas flow direction, the first porous body 112D is arranged upstream the gas flow and the second porous body 113D is arranged downstream the gas flow. A ring 114 is inserted into ends of the first porous body 112D and the second porous body 113D, thereby blocking gas inflow from the ends of the porous bodies, similarly to the case of the first embodiment.

As to the gas flow rate, therefore, the first porous body 112D first narrows down the gas flow rate and thereafter the second porous body 113D further narrows down the gas so that the gas flows out to a sliding part between the piston 103 and a cylinder 102. The dimensions of the first porous body 112D and the second porous body 113D are similar to those in the case of the first embodiment.

The weight of the piston can be reduced as compared with a porous body of a metal such as copper or stainless by employing a material of resin for the second porous body 113D. Particularly in the case of this Stirling engine, the weight of the piston remarkably influences a noise level with vibration of the engine body, and hence the weight can be reduced without disintegrating the resonance system of the piston. As the resin material, polyethylene, which has low water absorption for moisture, hardly inhales moisture despite its porosity, is easy to handle and at a low cost, is suitable for mass production. The material for the first porous body 112D may be prepared either from resin or from a metal. When employing a metal, the quantity of the used metal is preferably reduced in order to reduce the weight.

As to pores provided in the first porous body 112D, for example, holes of $\phi 1$ mm provided on four portions in the axial direction are provided on eight portions in the circumferential direction (32 holes in total). Thus, the pores are so formed in the first porous body 112D that gas effusion can be narrowed down as compared with a fully opened case. The size of the opening diameter and the number of the pores are decided by experimentally measuring the gas outflow.

(Function/Effect)

Thus, the gas flows out through the first porous body 112D and the second porous body 113D, whereby a function/effect similar to that of the aforementioned first embodiment can be attained.

(Fifth Embodiment)

A Stirling engine according to a fifth embodiment based on the present invention is now described with reference to the drawings. As to structures identical to those in the first embodiment, detailed description is omitted. The feature of the Stirling engine according to this embodiment resides in the structure of a piston, and hence only the structure of this piston is mentioned here.

Figure 11:
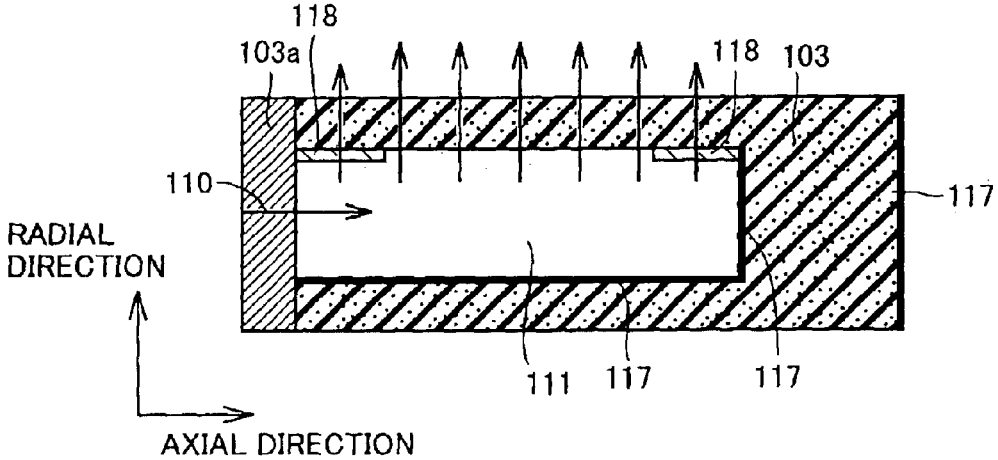
FIG. 11 is a diagram showing the sectional form of a piston in a fifth embodiment based on the present invention.

The structure of piston in this embodiment is described with reference to FIG. 11. FIG. 11 is a diagram showing the sectional form of a piston 103.

Referring to FIG. 11, the piston 103 itself is formed by a first porous material having large porosity in this embodiment, in order to form a region including a sliding surface with a cylinder 102 and a pressurization chamber 111 by a porous body in the piston 103. Further, second porous materials 118 having small porosity are inserted into both ends of the pressurization chamber 111 in the piston 103. This is because gas effusion from both ends of the piston 103 has a smaller ratio of contribution to floating of the piston 103 as compared with gas outflow and has a high possibility of resulting in gas loss, and it is more efficient to narrow down gas effusion on both ends. Portions other than a sliding part between the piston 103 and the cylinder 102, leading to gas loss, are subjected to blinding treatment (treatment similar to that in the case of the first embodiment) 117. Aluminum or the like is employed for a lid body 103*a* in view of weight reduction.

Polyethylene of 60% in porosity is employed for the first porous material. Polyethylene of 20% in porosity is employed for the second porous materials 118.

(Function/Effect)

In the aforementioned structure of the piston applied to the Stirling engine according to this embodiment, the material for the piston 103 is mainly composed of a porous body thereby eliminating a step of assembling one of two types of porous materials, whereby the cost can be reduced.

Further, the piston 103 is so prepared from a material of resin that the weight of the piston 103 can be reduced and a vibration level of the body can be reduced.

Polyethylene or the like having low moisture absorption is desirably employed also for the resin material in this embodiment.

While the structure of the gas effusion part provided on the piston 103 has been described in the aforementioned embodiment, a gas effusion part of the same structure can be employed also on the side of the displacer 104 shown in FIG. 1.

While the structure of the gas effusion part shown in each of the aforementioned first to fourth embodiments is described as to the case of the so-called orifice narrowing type hydrostatic gas bearing, the present invention is applicable to a hydrostatic gas bearing of a capillary narrowing type, a slot narrowing type, an automatic narrowing type, a porous narrowing type, a surface narrowing type or the like.

While the multilayer structure of porous materials is arranged in the piston 103 in the structure of the gas effusion part shown in each of the aforementioned first to fourth embodiments, it is also possible to employ a structure of providing a concave portion on the outer peripheral surface which is the motion surface of the piston 103 for arranging the multilayer structure of porous materials in this concave portion.

According to the Stirling engine based on the first invention, it is possible to obtain a Stirling engine comprising a gas bearing having both characteristics of narrowing down the gas flow rate, which has been hard to attain solely in the conventional porous body, and inhibiting clogging by effusing the gas through the first porous body having large porosity and the second porous body having small porosity thereby trapping large dust and narrowing down the gas in the first porous body and further narrowing down the gas in the second porous body.

(Sixth Embodiment)

Figure 12:
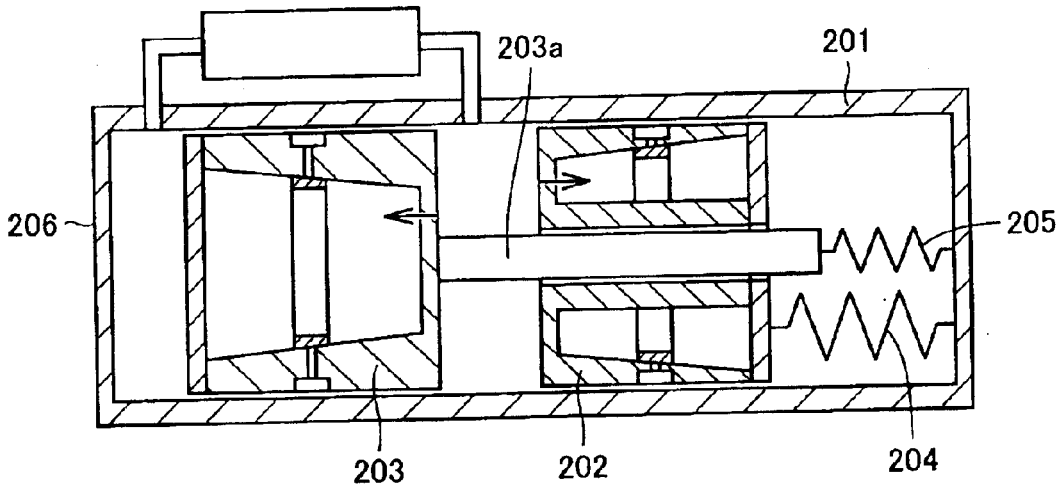
FIG. 12 is a sectional view showing the structure of a Stirling engine according to a sixth embodiment based on the present invention.

FIG. 12 is a sectional view showing the structure of a Stirling engine according to a sixth embodiment based on the present invention. Referring to FIG. 12, numeral 201 denotes a cylindrically formed pressure vessel, and this pressure vessel 201 is filled up with high-pressure gas as a medium. A columnar piston 202 having a through hole 202*a* (see FIG. 13) is arranged in the pressure vessel 201 while matching the central axis with this pressure vessel 201, and a columnar displacer 203 having a through part 203*a* passing through the through hole 202*a* of the piston 202 is also arranged.

The piston 202 is linearly driven by a piston driver (not shown) consisting of a linear motor or the like in the axial direction of the pressure vessel 201, for compressing and expanding gas in the pressure vessel 201. The piston 202 is supported on an end (right end in the figure) of the pressure vessel 201 opposite to the displacer 203 by a spring 204, not to deviate from a prescribed region.

Also as to the displacer 203, the forward end of the through part 203*a* is supported on the end (right end in the figure) of the pressure vessel 201 by a spring 205. The piston 202 moves in the direction (leftward in the figure) of the displacer 203 thereby compressing the gas between the piston 202 and the displacer 203 so that the displacer 203 moves in the direction (leftward in the figure) opposite to the piston 202. Then, the piston 202 moves in the direction (rightward in the figure) opposite to the displacer 203, whereby the gas between the piston 202 and the displacer 203 expands and the displacer 203 moves in the direction (rightward in the figure) of the piston 202. The piston 202 repeats reciprocation so that the displacer 203 also repeats the aforementioned motion, for compressing and expanding the gas.

An end (left end in the figure) of the pressure vessel 201 opposite to the displacer 203 closer to the piston 202 is formed as a cooling part 206, so that the said cooling part 206 performs action of reducing external heat and reducing the external temperature when the gas between the cooling part 206 and the displacer 203 expands.

Figure 13:
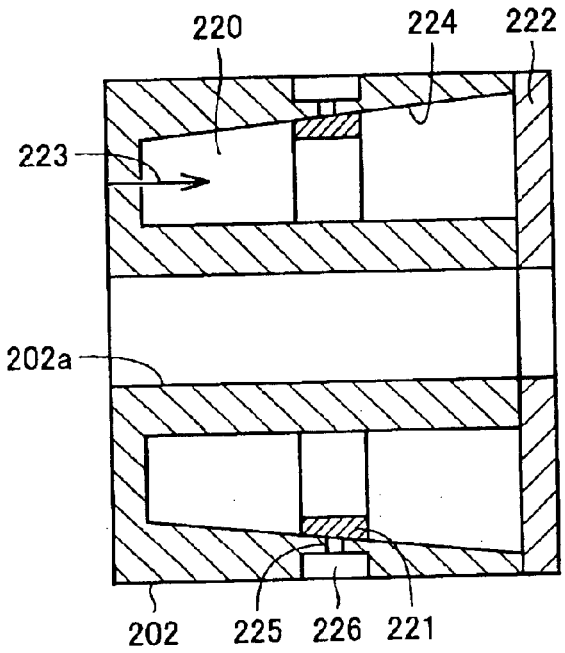
FIG. 13 is an enlarged view of a piston shown in FIG. 12.

FIG. 13 is an enlarged view of the piston 202 in FIG. 12. The piston 202 is prepared from an aluminum alloy in the form of a column having an outer diameter slightly smaller than the inner diameter of the pressure vessel 201 and provided on its center with the through hole 202*a*. A columnar pressurization chamber 220 matching its central axis with the said through hole 202*a* is provided inside the peripheral wall of the piston 202.

An end (left end in the figure) of the piston 202 closer to the displacer 203 has a one-way valve 223 inward from outside the pressurization chamber 220, so that the high-pressure gas compressed by reciprocation of the piston 202 and the displacer 203 flows into and is stored in the pressurization chamber 220 through the said one-way valve 223 thereby maintaining a high pressure state in the pressurization chamber 220.

The other end (right side in the figure) of the piston 202 is formed into an openable/closable lid body 222. The inner diameter of the pressurization chamber 220 is axially reduced from the end having the lid body 222, so that the inner surface of the peripheral wall of the piston 202 is consequently formed as a tapered surface 224 having an inclined angle with respect to the axial direction.

The piston 202 is manufactured by die forming, and the said tapered surface 224 is formed by an inclined surface employed for drawing out the piston 202 from the die.

A plurality (e.g., four equal distributions) of gas outlets each consisting of a through hole 225 and a cavity 226 from the side of the pressurization chamber 220 are provided on a substantially central portion of the outer peripheral wall of the piston 202. A porous body 221 annularly formed by polyethylene of 30% in porosity is so arranged in the pressurization chamber 220 as to block open ends of the said gas outlets closer to the pressurization chamber 220. The overall contact surface of the porous body 221 with the piston 202 has an angle of inclination similar to that of the said tapered surface 224. The diameter of holes provided in the porous body 221 is about 6 $\mu$m. It is assumed that porosity denotes a ratio occupied by the total volume of holes per unit volume. The gas in the pressurization chamber 220 passes through the through holes 225 and the cavities 226 through the porous body 221 and is injected to a sliding part between the piston 202 and the pressure vessel 201.

Insertion of the porous body 221 into the pressurization chamber 220 is performed by opening the lid body 222, inserting the porous body 221 into the pressurization chamber 220 from the end having a smaller outer diameter, arranging the same on a prescribed position and thereafter closing the lid body 222.

When inserted into the pressurization chamber 220, the porous body 221 is desirably inserted while controlling a load to 5 to 10 kgf in order to prevent breakage of the porous body 221.

In the Stirling engine comprising the gas effusion part of the aforementioned structure, the pressurization chamber 220 is so formed that the inner diameter is reduced inward from the lid body 222 and the outer peripheral surface of the porous body 221 also has a similar degree of angle of inclination, whereby adhesion between the porous body 221 and the outer peripheral wall of the piston 202 is strengthened as the porous body 221 is axially forced from the lid body 222 so that the quantity of gas injection to the sliding part between the piston 202 and the pressure vessel 201 can be stabilized while preventing injection loss of the gas.

While the outer peripheral surface of the porous body 221 and the contact surface of the piston 202 with the porous body 221 have angles of inclination in the aforementioned embodiment, either the outer peripheral surface of the porous body 221 or the contact surface of the piston 202 with the porous body 221 may alternatively have an angle of inclination.

(Seventh Embodiment)

Figure 14:
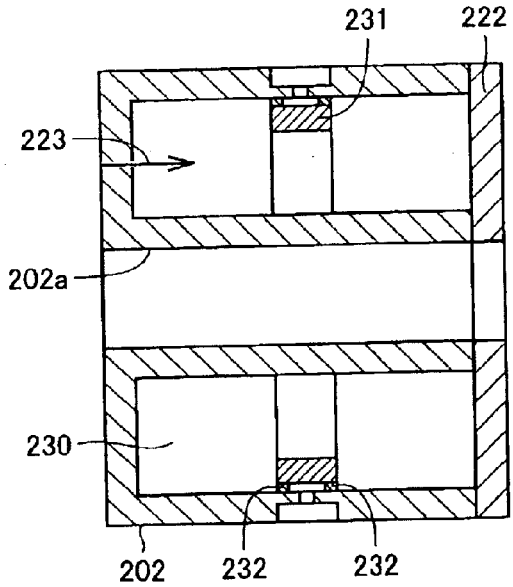
FIG. 14 is a sectional view of a piston in a seventh embodiment based on the present invention.

FIG. 14 is an axial sectional view of a piston 202 in a seventh embodiment. A pressurization chamber 230 provided in the piston 202 according to this embodiment is in the form of a cylinder matching its central axis with a through hole 202*a*, and a porous body 231 annularly formed by polyethylene having porosity of 30% is arranged in this pressurization chamber 230 thereby blocking open ends of gas outlets closer to the pressurization chamber 230.

On a contact surface of the porous body 231 with the piston 202, a constraint portion 232 consisting of a synthetic resin material hardened at the room temperature is applied onto a proper region from both open ends.

If a material having low viscosity is employed for the constraint portion 232, the porous body 231 absorbs the constraint portion 232 and breaks pores provided in the porous body 231, and hence it is desirable to select a material having high viscosity.

In a Stirling engine comprising a gas effusion part of the aforementioned structure, the viscous constraint portion 232 is applied to the contact surface of the porous body 231 with the piston 202, whereby the piston 202 constrains the porous body 231 through the constraint portion 232 so that the porous body 231 does not move from a prescribed position during engine operation either while the constraint portion 232 can prevent gas injection loss from the outer peripheral portion of the porous body 231 for stabilizing the quantity of gas injected to a sliding part between the piston 202 and a pressure vessel 201.

As to the piston 202, elements similar in structure to those of the aforementioned sixth embodiment are denoted by similar reference numerals, and description thereof is omitted. The structure of the overall Stirling engine is similar to that according to the sixth embodiment, and hence description thereof is omitted.

(Eighth Embodiment)

Figure 15:
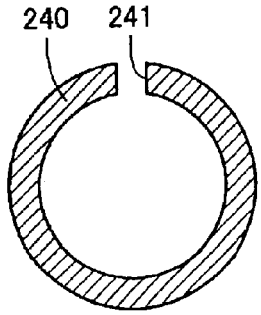
FIG. 15 is a sectional view of a porous body in an eighth embodiment based on the present invention.

FIG. 15 is a sectional view of a porous body in an eighth embodiment in a direction perpendicular to its central axis. Referring to FIG. 15, numeral 240 denotes the porous body, and this porous body 240 is annularly formed by polyethylene of 30% in porosity to have an inner diameter slightly larger than the outer diameter of a pressurization chamber 230. The porous body 240 includes a notched portion 241 having a proper width in the circumferential direction.

In a Stirling engine comprising the porous body 240 having the aforementioned structure, the porous body 240 is formed slightly larger than the inner diameter of the pressurization chamber 230 with the notched portion 241 formed in the circumferential direction, whereby the outer diameter of the porous body 240 can be reduced by reducing the width of the notched portion 241 thereby simplifying insertion into the pressurization chamber 230. After the porous body 240 is inserted into the pressurization chamber 230, restoring force is caused on the notched portion 241 thereby strengthening adhesion between the porous body 240 and the peripheral wall of a piston 202 so that the quantity of gas injected to a sliding part between the piston 202 and a pressure vessel 201 can be stabilized while preventing injection loss of the gas.

The structures of the piston and the Stirling engine are similar to those in the aforementioned seventh embodiment, and hence description thereof is omitted.

(Ninth Embodiment)

Figure 16:
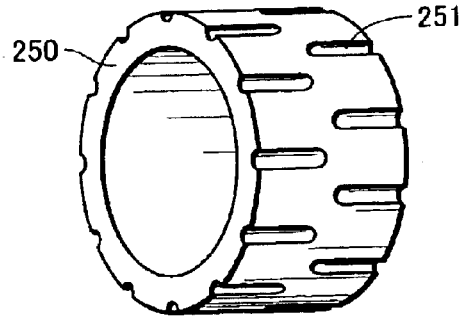
FIG. 16 is a perspective view of a porous body in a ninth embodiment based on the present invention.

FIG. 16 is a perspective view of a porous body in a ninth embodiment. Referring to FIG. 16, numeral 250 denotes a porous body, and this porous body 250 is annularly formed by polyethylene of 30% in porosity, and provided on the outer peripheral surface with 12 slits 251 having a proper length in the axial direction alternately from each open end.

In a Stirling engine having the porous body 250 of the aforementioned structure, a plurality of slits 251 are so formed on a contact surface of the porous body 250 with a piston 202 that the outer diameter of the porous body 250 can be reduced by reducing the width of the slits 251 thereby simplifying insertion into a pressurization chamber 230. After the porous body 250 is inserted into the pressurization chamber 230, restoring force is caused on the slits 251 thereby strengthening adhesion between the porous body 250 and the peripheral wall of a piston 202 so that the quantity of gas injected to a sliding part between the piston 202 and a pressure vessel 201 can be stabilized while preventing injection loss of the gas.

The structures of the piston and the Stirling engine are similar to those in the aforementioned seventh embodiment, and hence description thereof is omitted.

(Tenth Embodiment)

Figure 17:
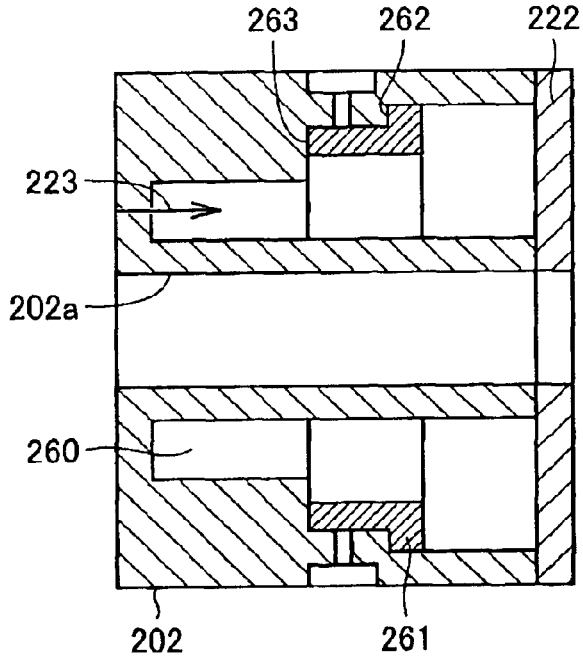
FIG. 17 is a sectional view of a piston in a tenth embodiment based on the present invention.

FIG. 17 is an axial sectional view of a piston 202 in a tenth embodiment. A pressurization vessel 260 in the piston 202 according to this embodiment has step portions 262 and 263 perpendicular to the axial direction on two portions through open ends of gas outlets closer to the pressurization chamber 260. The step portions 262 and 263 are so formed that the inner diameters are reduced stepwise axially from a lid body 222. The length of the step portions 262 and 263 is desirably set to at least 1 mm, in order to prevent injection loss of gas from the outer peripheral portion of a porous body 261.

The porous body 261 annularly formed by polyethylene having porosity of 30% is arranged in the vicinity of the gas outlets in the pressurization chamber 260 thereby blocking open ends of the said gas outlets closer to the pressurization chamber 260. The porous body 261 is provided on its outer peripheral surface with a projection formed by increasing the thickness from an end up to a proper region.

In a Stirling engine having the pressurization chamber 260 of the aforementioned structure, the porous body 261 is inserted into the pressurization chamber 260 from an end having no projection when the porous body 261 is inserted into the pressurization chamber 260. The projection of the porous body 261 joins with the step portion 262, thereby simplifying positioning of the porous body 261 in the pressurization chamber 260. The end of the porous body 261 having no projection joins with the step portion 263, whereby the joint surfaces formed by the step portions 262 and 263 so prevent injection loss of gas that the quantity of injection of the gas to a sliding part between the piston 202 and a pressure vessel 201 can be stabilized.

As to the piston 202, elements similar in structure to those of the aforementioned sixth embodiment are denoted by similar reference numerals, and description thereof is omitted. The structure of the overall Stirling engine is similar to that according to the sixth embodiment, and hence description thereof is omitted.

(Eleventh Embodiment)

Figure 18:
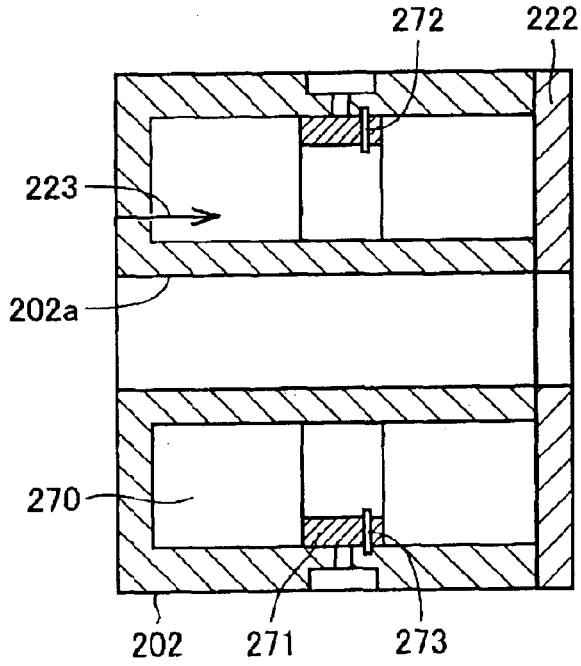
FIG. 18 is a sectional view of a piston in an eleventh embodiment based on the present invention.

FIG. 18 is an axial sectional view of a piston 202 in an eleventh embodiment. A pressurization chamber 270 in the piston 202 according to this embodiment is in the form of a cylinder matching its central axis with a through hole 202*a*. On the inner surface of the outer peripheral wall of the piston 202, a plurality of pores 272 capable of receiving the forward ends of pins 273 are substantially concentrically provided on positions separated from gas outlets by proper distances. A porous body 271 annularly formed by polyethylene having porosity of 30% is arranged in the vicinity of the gas outlets in the pressurization chamber 270, thereby blocking open ends of the said gas outlets closer to the pressurization chamber 270.

In a Stirling engine having the pressurization chamber 270 of the aforementioned structure, the porous body 271 is arranged on a prescribed position for thereafter passing the pins 273 through the porous body 271 and further inserting the forward ends of the pins 273 into the pores 272 provided on the outer peripheral surface of the pressurization chamber 270 when the porous body 271 is inserted into the pressurization chamber 271. Thereafter the forward ends of the pins 273 are fixed to the pores 272 with an adhesive, so that the porous body 271 does not move from the prescribed position during engine operation either. Therefore, a gas passage can be stabilized for stabilizing the quantity of gas injected to a sliding part between the piston 202 and a pressure vessel 201.

As to the piston 202, elements similar in structure to those of the aforementioned sixth embodiment are denoted by similar reference numerals, and description thereof is omitted. The structure of the overall Stirling engine is similar to that according to the sixth embodiment, and hence description thereof is omitted.

While the porous body is prepared from polyethylene in each of the aforementioned sixth to eleventh embodiments, another synthetic resin material may be employed, or a material other than the synthetic resin material may be employed.

While the structure of the gas effusion part provided on the piston 202 has been described in each of the aforementioned embodiments, the displacer 203 shown in FIG. 12 may also include a gas effusion part having a similar structure.

According to the present invention, the porous body has a tapered surface and this porous body is inserted into the pressurization chamber provided in an effector from a portion having a small outer diameter so that a load for reducing the diameter is applied to the said tapered surface thereby causing restoring force for enlarging the diameter on the tapered surface after insertion of the porous body into the pressurization chamber, whereby adhesion between the porous body and the effector is strengthened. Further, the inner side of the peripheral wall of the effector has a tapered surface and the porous body is inserted from a portion of the pressurization chamber having a large inner diameter so that a load for enlarging the diameter is applied to the tapered surface and restoring force for reducing the diameter is caused on the tapered surface after insertion into the pressurization chamber, whereby adhesion between the porous body and the effector is strengthened. Therefore, the porous body does not move from the prescribed position during engine operation either, so that the passage of the gas can be stabilized and the effector can stably reciprocate by equalizing the quantities of the gas injected from the respective gas outlets.

According to the present invention, the constraint portion has viscosity and the porous body is arranged in the pressurization chamber provided in the effector through the said constraint portion so that viscosity of the said constraint portion increases constraining force between the porous body and the effector. Therefore, the porous body does not move from the prescribed position during engine operation either, so that the passage of the gas can be stabilized and the effector can stably reciprocate by equalizing the quantities of the gas injected from the respective gas outlets.

According to the present invention, the constraint portion is provided to enclose the peripheral edge of the through hole and the porous body is constrained on the effector through the said constraint portion, whereby injection loss of the gas from the outer peripheral portion of the porous body can be reduced. Therefore, the passage of the gas can be stabilized and the effector can stably reciprocate by equalizing the quantities of the gas injected from the respective gas outlets.

According to the present invention, insertion of the porous body into the pressurization chamber is simplified by reducing the width of the notched portion or the slits thereby changing the outer diameter of the porous body. After insertion of the porous body into the pressurization chamber, restoring force for enlarging the width is caused on the notched portion or the slits, thereby strengthening adhesion between the porous body and the peripheral wall of the effector. Therefore, the porous body does not move from the prescribed position during engine operation either, so that the passage of the gas can be stabilized and the effector can stably reciprocate by equalizing the quantities of the gas injected from the respective gas outlets.

According to the present invention, the projection provided on the porous body is stopped by the step portion in the pressurization chamber when the porous body is inserted into the pressurization chamber, whereby the porous body can be readily arranged on the prescribed position in the pressurization chamber.

According to the present invention, the pressurization chamber has the step portions on two portions through the open end of the through hole and the porous body joins with the respective step portions so that the joint surfaces thereof reduce injection loss of the gas. The passage of the gas is stabilized by reducing the injection loss of the gas, and the effector can stably reciprocate by equalizing the quantities of the gas injected from the respective gas outlets.

According to the present invention, the porous body is fixed to the peripheral wall of the effector with the pins, so that the porous body does not move from the prescribed position. Therefore, the passage of the gas can be stabilized and the effector can stably reciprocate by equalizing the quantities of the gas injected from the respective gas outlets.

According to the present invention, the porous body is prepared from the synthetic resin material, so that adhesion of the porous body to the effector can be reinforced. Therefore, the porous body does not move from the prescribed position during engine operation either, so that the passage of the gas can be stabilized and the effector can stably reciprocate by equalizing the quantities of the gas injected from the respective gas outlets. Further, the weight of the piston is so reduced that vibration and noise can be reduced in engine operation.

(Twelfth Embodiment)

Figure 19:
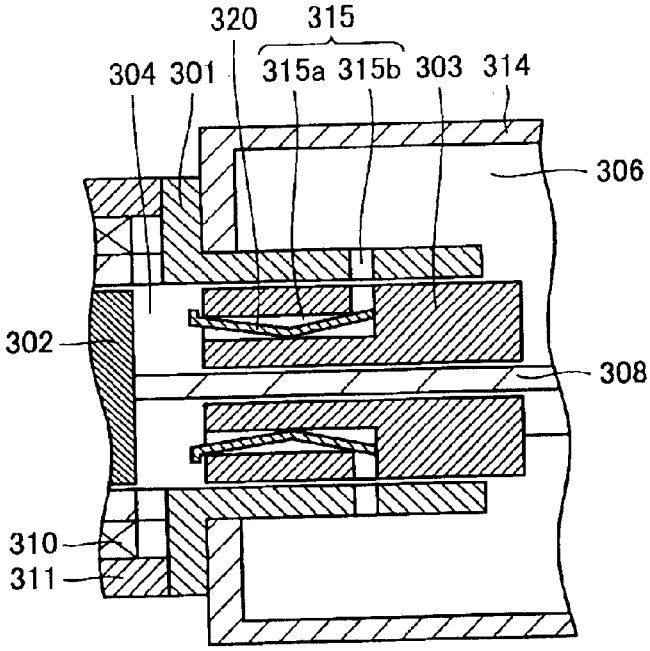
FIG. 19 is a partially fragmented sectional view of a Stirling engine according to a twelfth embodiment based on the present invention in the vicinity of a communication path.

FIG. 19 is a partially fragmented sectional view for illustrating a structure in the vicinity of a communication path of a Stirling engine according to a twelfth embodiment o the present invention. This embodiment optimizes the flow rate of gas circulating through the communication path by employing a simple technique when specification change is made in the Stirling engine described in each of the aforementioned embodiments, and the remaining structure of the Stirling engine is similar to that of the prior art.

(Structure of Communication Path)

The structure of the communication path connecting a compression space and a back pressure space in the Stirling engine according to this embodiment is described with reference to FIG. 19. An in-piston communication passage 315*a* is provided in a piston 303, for forming a passage for gas from an outer wall surface of the piston 303 closer to a compression space 304 up to an outer wall surface of the piston 303 opposite to a cylinder 301. Further, a communication hole 315*b* is provided on the cylinder wall surface to reach an outer wall surface facing an external back pressure space 306 from an inner wall surface facing the internally engaged piston 303.

The in-piston communication passage 315*a* and the communication hole 315*b* are desirably provided on positions coupled with each other when the piston 303 is on its amplitude center position, thereby attaining pressure balance between the compression space 304 and the back pressure space 306 and preventing displacement of the amplitude center position of the piston 303. A gas bearing (not shown) is provided on the piston 303 so that the piston 303 reciprocates in the cylinder 301 without coming into contact with the inner wall surface of the cylinder 301, thereby defining a clearance between the piston 303 and the inner wall of the cylinder 301. While the aforementioned communication path 315 is formed to hold this clearance, the clearance itself has a thickness of only about several 10 μm and hence the gas circulating through the communication path 315 does not substantially flow into this clearance.

(Structure of Inserted Substance and Insertion Method)

An inserted substance for reducing the sectional area is inserted into and mounted on the aforementioned in-piston communication passage 315*a*. This inserted substance may be any substance so far as the same is insertable into the in-piston communication passage 315*a*, and the shape of and the material for the same are not particularly restricted. This embodiment employs a wire of a metal folded several times to be provided with elastic force for the purpose of convenience of operation in manufacturing and prevention of displacement after mounting.

A wire 320 which is this inserted substance is inserted from an opening of the in-piston communication passage 315*a* closer to the compression space 304, and comes into contact with the wall surface of the in-piston communication passage 315*a* on several potions thereby spring-fitting with the same, and is held/fixed. Further, a single end of this wire 320 partially projects from the in-piston communication passage 315*a* toward the compression space 304 and this part is folded substantially parallelly to the outer wall surface of the piston 303 and bonded with an adhesive or the like, to be strongly fixed. Thus, the wire 320 is prevented from displacement also in reciprocative motion of the piston 303.

(Function/Effect)

According to the Stirling engine having the aforementioned structure, the wire is inserted into and fixed to the in-piston communication passage thereby reducing the sectional area of part of the communication path when the specification of the Stirling engine is changed, whereby the flow rate of the gas circulating through the communication path can be controlled. While the optimum value of the flow rate of the gas circulating through the communication path for keeping pressure balance between the compression space and the back pressure space varies with the current situation from moment to moment as hereinabove described, the pressure balance is attained at a certain constant flow rate at least in steady operation, whereby it is possible to find the optimum gas flow rate. When the optimum gas flow rate is reduced following specification change, therefore, the gas flow rate can be simply controlled to the optimum level at a low cost without re-manufacturing the Stirling engine by inserting the wire into the communication path and fixing the same. Thus, efficiency of the Stirling engine can be improved.

Figure 20:
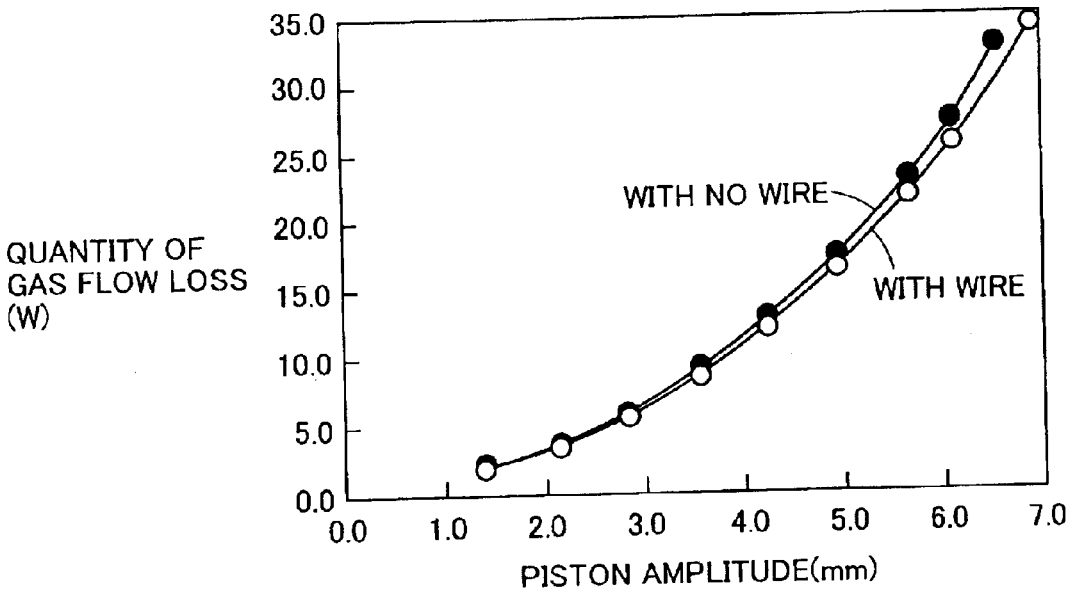
FIG. 20 is a diagram showing an effect of reducing working gas flow loss in a case of using the Stirling engine according to the twelfth embodiment based on the present invention.

FIG. 20 is a diagram showing specific experimental results of a gas flow loss reducing effect of the Stirling engine according to this embodiment. Referring to the figure, the horizontal axis shows piston amplitudes and the vertical axis shows quantities of gas flow loss. Two curves in the figure compare respective quantities of gas flow loss in a case of mounting a wire for optimizing the gas flow rate and a case of mounting no wire when specification change is made. These quantities of gas flow loss are calculated by reducing loss quantities related to motors from quantities of power input in the motors for driving pistons. As shown in the figure, it has been confirmed that the quantity of gas flow loss was reduced by inserting the wire under each amplitude condition of the piston.

(Thirteenth Embodiment)

Figure 21:
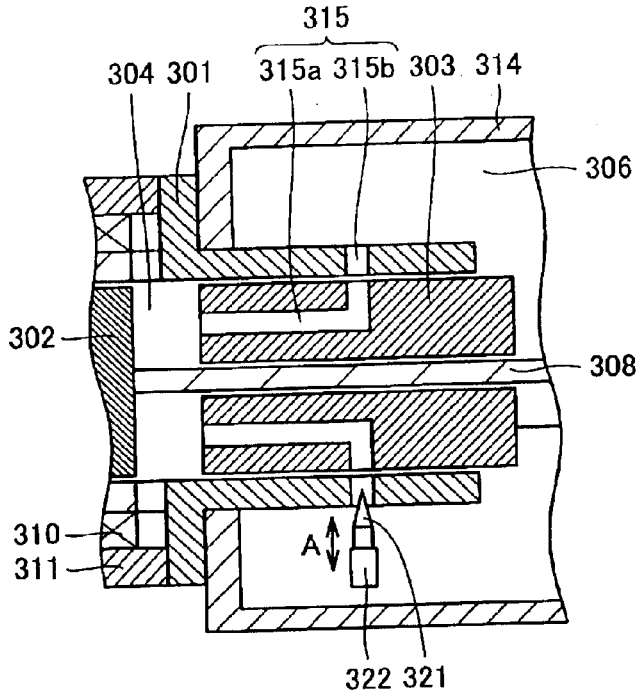
FIG. 21 is a partially fragmented sectional view of a Stirling engine according to a thirteenth embodiment based on the present invention in the vicinity of a communication path.

FIG. 21 is a partially fragmented sectional view for illustrating a structure in the vicinity of a communication path of a Stirling engine according to a thirteenth embodiment of the present invention. The Stirling engine according to this embodiment is a Stirling engine capable of freely controlling the flow rate of gas circulating through the communication path.

(Gas Flow Control Means)

Referring to FIG. 21, a communication path 315 of the Stirling engine according to this embodiment is similar in structure to that in the aforementioned twelfth embodiment, and description thereof is omitted. A needle valve 321 which is valve means is set on a back pressure space 306 side of a communication hole 315*b* provided on a cylinder 301, and this needle valve 321 is mounted on a stepping motor 322. The forward end of the needle valve 321 is in the form of a circular cone. The forward end of this needle valve 321 is set on a position receivable/dischargeable (along arrow A in the figure) in/from the communication hole 315*b*, so that the stepping motor 322 inserts the forward end of the needle valve 321 up to a prescribed position in this communication hole 315*b* thereby adjusting the opening area of the communication hole 315*b*.

(Function/Effect)

It is possible to control the sectional area of the communication hole for suppressing gas flow loss which is miscellaneous loss by varying the quantity of insertion of the needle valve with the optimum gas flow rate changing from moment to moment due to provision of the gas flow control means having the aforementioned structure. This optimum gas flow rate depends on the amplitude of the piston, the temperature of working gas in a compression space, the temperature of gas in the back pressure space and the like, and hence it is also possible to automatically control the gas flow rate by grasping how the optimum gas flow rate varies with these states.

Figure 22:
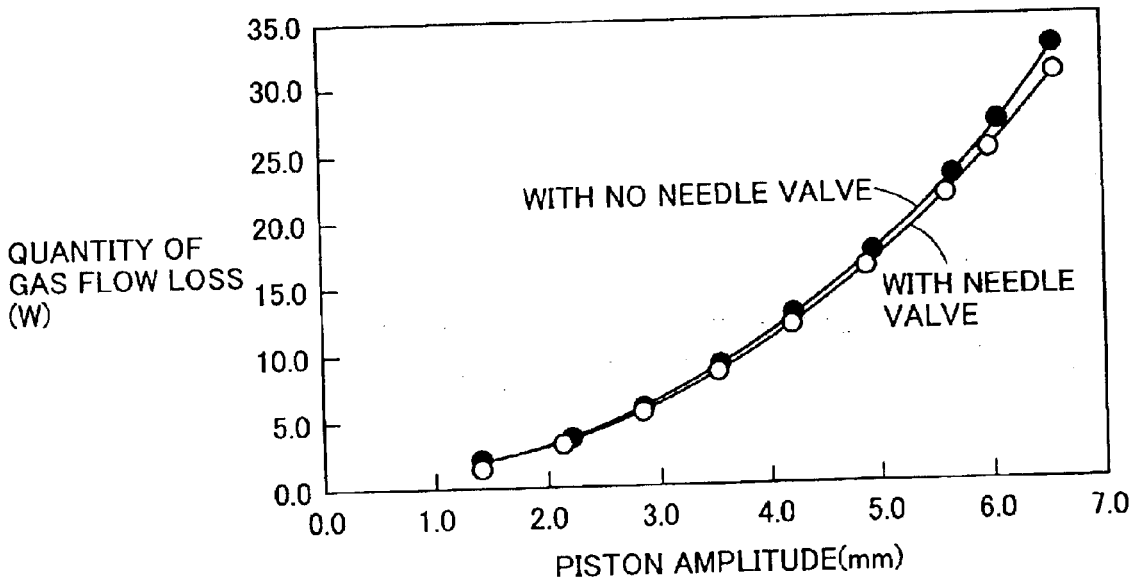
FIG. 22 is a diagram showing an effect of reducing working gas flow loss in a case of using the Stirling engine according to the thirteenth embodiment based on the present invention.

FIG. 22 is a diagram showing specific experimental results of a gas flow loss reducing effect of the Stirling engine according to this embodiment. Referring to the figure, the horizontal axis shows piston amplitudes and the vertical axis shows quantities of gas flow loss. The figure compares respective quantities of gas flow loss in a case of mounting a needle valve and a case of mounting no needle valve when specification change is made. These quantities of gas flow loss are calculated by a method similar to that in the aforementioned twelfth embodiment. As shown in the figure, it has been confirmed that the quantity of gas flow loss was reduced by providing the needle valve under each amplitude condition of the piston.

(Fourteenth Embodiment)

Figure 23:
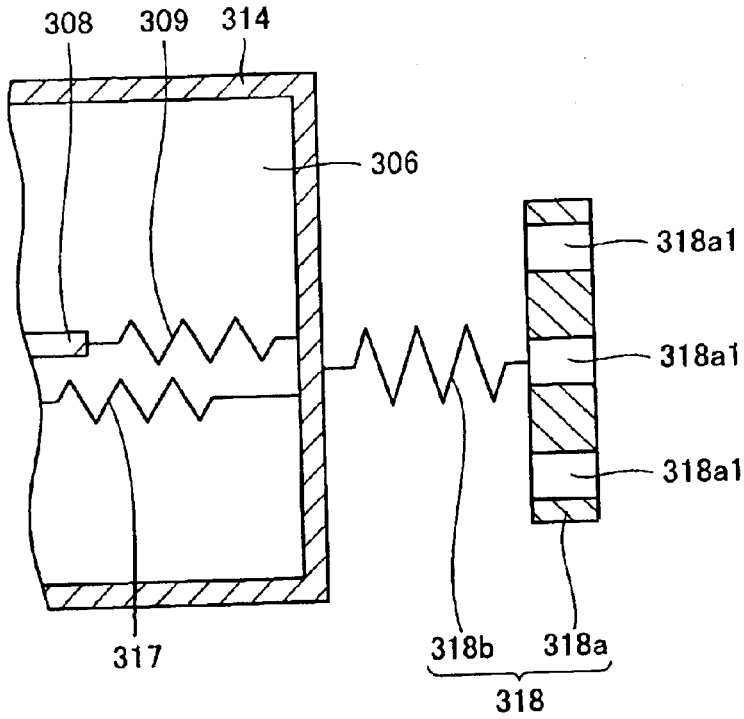
FIG. 23 is an partial sectional view of a Stirling engine according to a fourteenth embodiment based on the present invention in the vicinity of a dynamic vibration damping mechanism.

FIG. 23 is a partially fragmented sectional view for illustrating a structure in the vicinity of a dynamic vibration damping mechanism of a Stirling engine according to a fourteenth embodiment of the present invention. The Stirling engine according to this embodiment comprises a mechanism for reducing motion loss of the dynamic vibration damping mechanism provided for reducing the quantity of miscellaneous loss resulting from vibration of the Stirling engine itself.

(Structure of Dynamic Vibration Damping Mechanism)

Referring to FIG. 23, a dynamic vibration damping mechanism 318 according to this embodiment is formed by an elastic part 318*b* mounted on a casing 314 of the Stirling engine and a mass part 318*a* mounted on this elastic part, similarly to the conventional dynamic vibration damping mechanism 318. In this embodiment, a through hole 318*a*1 is provided in the vibrational direction of the mass part 318*a*.

(Function/Effect)

In the aforementioned structure, a through hole provided in the dynamic vibration damping mechanism reduces air resistance against motion of the dynamic vibration damping mechanism, thereby reducing miscellaneous loss of the Stirling engine and preventing generation of noise.

(Fifteenth Embodiment)

Figure 24:
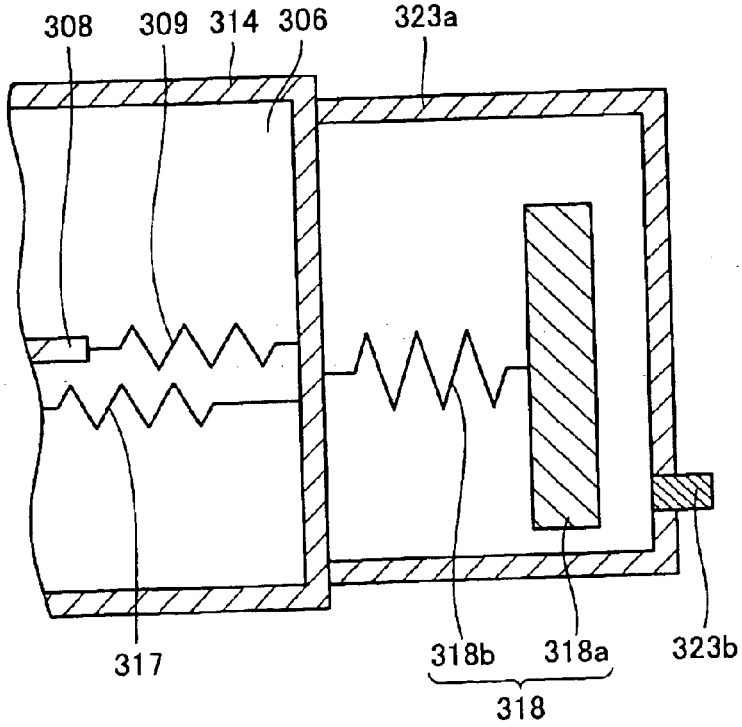
FIG. 24 is an partial sectional view of a Stirling engine according to a fifteenth embodiment based on the present invention in the vicinity of a dynamic vibration damping mechanism.

FIG. 24 is a partially fragmented sectional view for illustrating a structure in the vicinity of a dynamic vibration damping mechanism of a Stirling engine according to a fifteenth embodiment of the present invention. The Stirling engine according to this embodiment comprises the dynamic vibration damping mechanism for reducing the quantity of miscellaneous loss resulting from vibration of the Stirling engine itself, and the dynamic vibration damping mechanism according to this embodiment is different in mode from that according to the aforementioned fourteenth embodiment.

(Structure of Dynamic Vibration Damping Mechanism)

Referring to FIG. 24, a dynamic vibration damping mechanism 318 according to this embodiment is formed by an elastic part 318*b* mounted on a casing 314 of the Stirling engine and a mass part 318*a* mounted on this elastic part 318*b*, similarly to the conventional dynamic vibration damping mechanism. According to this embodiment, a vacuum vessel 323*a* is mounted on an outer portion of the casing 314 of the Stirling engine, so that the elastic part 318*b* and the mass part 318*a* of the dynamic vibration damping mechanism 318 are arranged in this vacuum vessel 323*a*. A suction port 323*b* is provided on a prescribed position of this vacuum vessel 323*a* and decompression means keeps the inner part of the vacuum vessel 323*a* in a vacuum state from this suction port 323*b* in a manufacturing step, for sealing the vacuum vessel 323*a* by closing the suction port 323*b*.

(Function/Effect)

The vacuum vessel is kept in a vacuum state in the aforementioned structure, whereby motion loss of the dynamic vibration damping mechanism is eliminated and the quantity of miscellaneous loss of the Stirling engine is also reduced due to elimination of air resistance against vibration of the dynamic vibration absorbing mechanism.

(Other Modified Examples)

While the aforementioned twelfth embodiment illustrates and describes a bar member as the member inserted into the piston, the present invention is not particularly restricted to this but any member is employable so far as the same has a shape reducing the sectional area of the communication path in a constant range, and the bar member may be wound on a coil, for example.

The thickness of the wall surface of the cylinder is generally small and hence the bar member is inserted into only the communication passage provided in the piston in this embodiment, while the bar member may be inserted into a communication passage provided on the wall surface of the cylinder if the wall surface of the cylinder is sufficiently thick.

While the aforementioned thirteenth embodiment illustrates and describes the method of controlling the opening area of the communication path with the needle valve having the sectional area reduced toward the forward end, the present invention is not particularly restricted to this but a lid may be mounted on the opening of the communication path for controlling the opening area of the communication path by opening/closing this lid, for example.

While all of the aforementioned embodiments are illustrated and described with reference to Stirling engines, the present invention is also applicable to a Stirling refrigerator which is exemplary application of this Stirling engine, as a matter of course.

According to the inventive Stirling engine comprising the gas flow control means, it is possible to freely control the flow rate of the gas circulating through the communication path thereby enabling provision of a highly efficient Stirling engine reduced in miscellaneous loss.

More specifically, it is possible to control the flow rate of the gas circulating through the communication path by an easy and simple method according to the inventive Stirling engine comprising the gas flow control means without re-manufacturing the piston also when specification change is made. Therefore, it is possible to provide a Stirling engine having high efficiency at a lower cost.

According to the Stirling engine comprising the gas flow rate control means described in the present invention, it is possible to control the flow rate of the gas circulating through the communication path in coincidence with the optimum gas flow rate changing in response to the operational situation from moment to moment. Thus, it is possible to remarkably reduce gas flow loss which is a factor reducing the efficiency of the Stirling engine, and it is possible to provide a highly efficient Stirling engine.

Further, motion loss of the dynamic vibration damping mechanism mounted for suppressing vibration of the Stirling engine itself is reduced according to the inventive Stirling engine comprising the dynamic vibration damping mechanism, whereby it is possible to reduce the quantity of miscellaneous loss of the Stirling engine resulting from this. Thus, it is possible to provide a Stirling engine having high efficiency and causing small noise.

(Sixteenth Embodiment)

(Structure)

Figure 25:
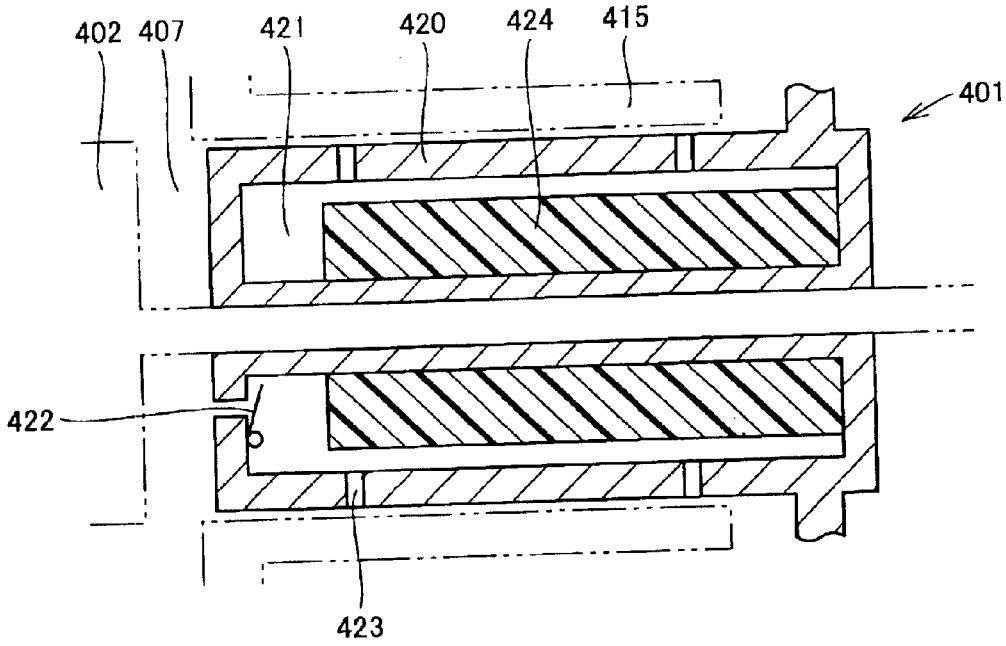
FIG. 25 is a sectional view of a piston in a sixteenth embodiment based on the present invention.
Figure 26:
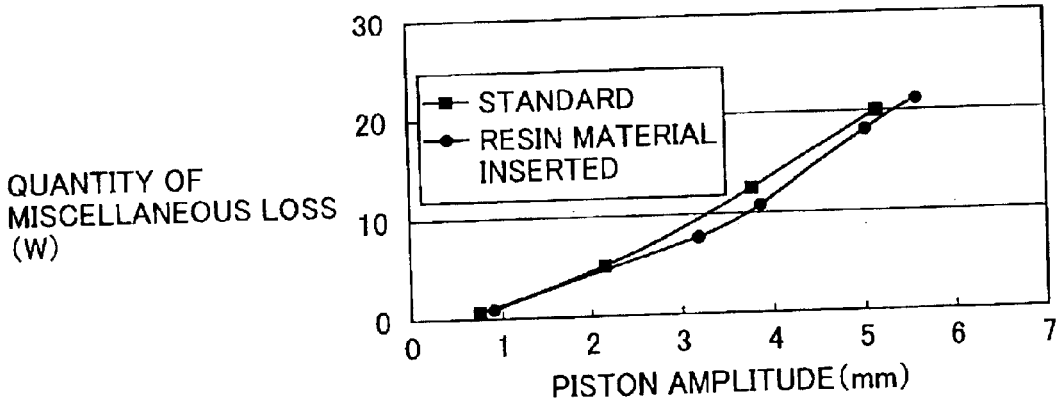
FIG. 26 is a graph comparing quantities of miscellaneous loss in a Stirling refrigerator according to the sixteenth embodiment based on the present invention and a conventional Stirling refrigerator.

A Stirling refrigerator according to a sixteenth embodiment based on the present invention is described with reference to FIGS. 25, 26 and 35. A free-piston Stirling refrigerator as the Stirling refrigerator according to this embodiment is roughly identical in structure to the conventional one shown in FIG. 35. However, the structure of an internal space 421 of a piston 401 is different from that of the conventional one (see FIG. 36), as shown in FIG. 25. In other words, a lightweight internal member 424 is arranged in the internal space 421 of the piston 401. The lightweight internal member 424 is arranged not to interfere with operation of a check valve 422 and to be located on a position not inhibiting working gas from flowing into a gas bearing hole 423. The lightweight internal member 424 is provided in the form of a cylinder, for example, and fixed by engaging a cavity portion in the cylinder on an outer peripheral portion of a rod 409 of the piston 401. The lightweight internal member 424 is a member containing a material smaller in specific gravity than a material forming an outer shell 420 of the piston 401. More specifically, a material such as plastic or rubber is selected.

(Function/Effect)

The capacity of the internal space 421 can be reduced while keeping the outer shell 420 thin and keeping the internal space 421 large for reducing the weight of the piston 401 due to the arrangement of the lightweight internal member 424.

Figure 35:
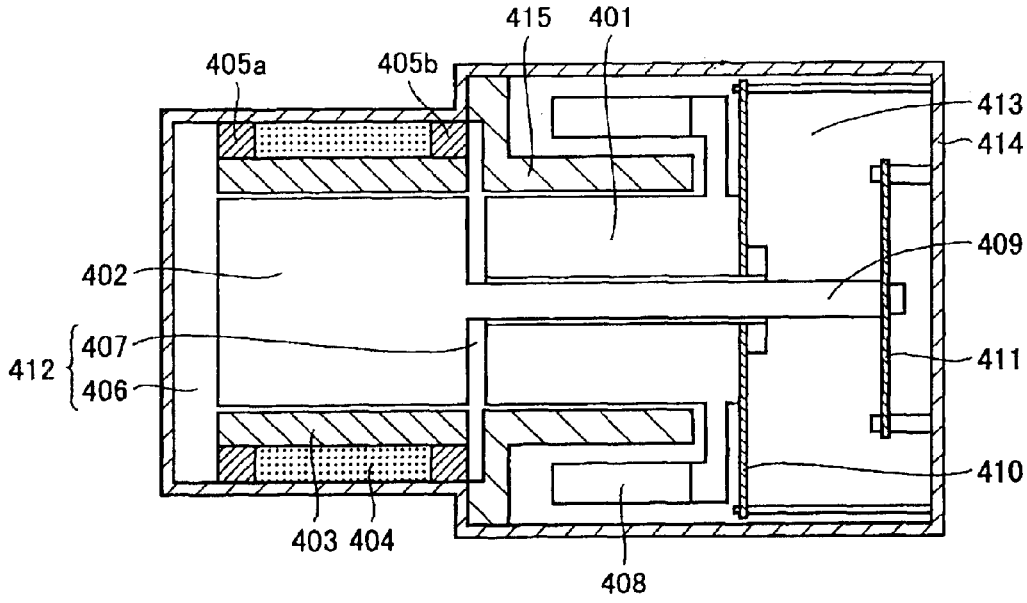
FIG.35 PRIOR ART
FIG. 35 is a sectional view of a Stirling refrigerator according to fourth prior art.
Figure 36:
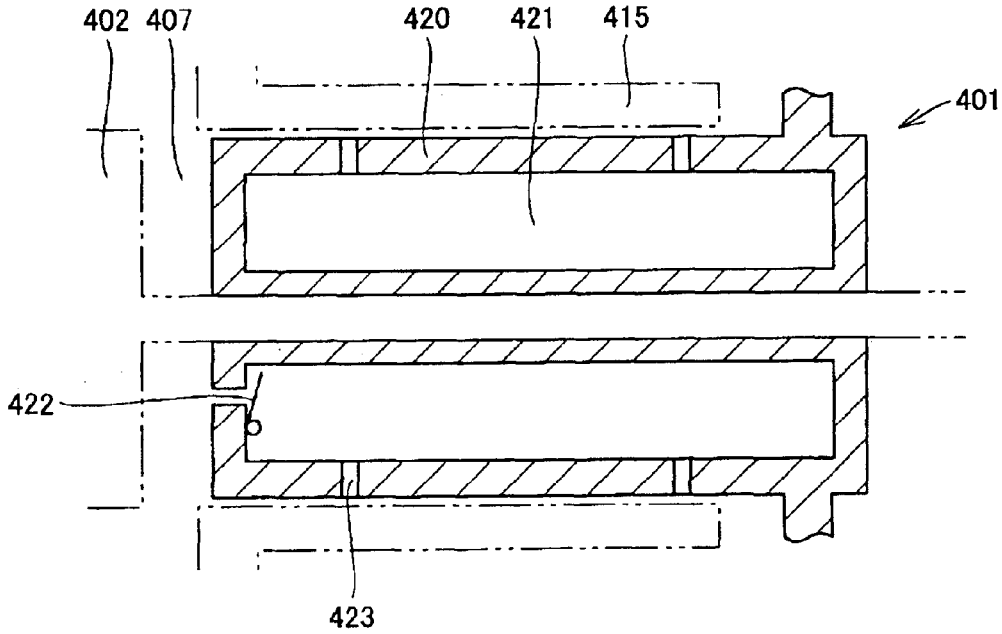
FIG.36 PRIOR ART
FIG. 36 is a sectional view of a piston employed for the Stirling refrigerator according to the fourth prior art.

In the conventional Stirling refrigerator shown in FIGS. 35 and 36, force in the direction of the working gas flowing from the compression space 407 into the internal space 421 following movement of the piston 401 is applied in a step of compressing the compression space 407 with the piston 401 so that the check valve 422 opens and the compression space 407 and the internal space 421 communicate with each other. When noting this compression step, the compression space 407 and the internal space 421 communicate with each other, whereby the internal space 421 also forms part of a compressed region. At this time, the volume of the compressed region is increased thereby increasing the quantity of compression work performed by the piston 401. Increase of the quantity of compression work results in increase of the quantity of the so-called miscellaneous loss in the cycle of the Stirling refrigerator.

According to this embodiment, on the other hand, the lightweight internal member 424 is arranged in the internal space 421 to block the space thereby reducing the capacity of the internal space 421, and hence the volume of a compressed region can be inhibited from increase also when the communication space 407 and the internal space 421 communicate with each other. Consequently, increase of the quantity of compression work can be suppressed. Therefore, the Stirling refrigerator can be inhibited from increase of the quantity of miscellaneous loss. When the Stirling refrigerator can be inhibited from increase of the quantity of miscellaneous loss, this means that input energy necessary for operation of the Stirling refrigerator may be small and efficiency of the Stirling refrigerator can be improved. FIG. 26 shows comparison of the conventional Stirling refrigerator comprising the piston shown in FIG. 36 and the Stirling refrigerator according to this embodiment comprising the piston shown in FIG. 25. In this example, an effect of reducing the quantity of miscellaneous loss by about 1 to 2 W is observed due to insertion of a resin material as the lightweight internal member 424.

The resin material is so light that increase of weight is small also when the same is arranged to occupy most part of the internal space 421, not to exert remarkable influence on the dynamic system or performance of the Stirling refrigerator. Rubber or resin employed as the lightweight internal member 424 is extremely low-priced, and the cost required for manufacturing the piston 401 may not be much increased.

According to this embodiment, as hereinabove described, a Stirling refrigerator having small miscellaneous loss and excellent efficiency is obtained.

(Seventeenth Embodiment)

(Structure)

Figure 27:
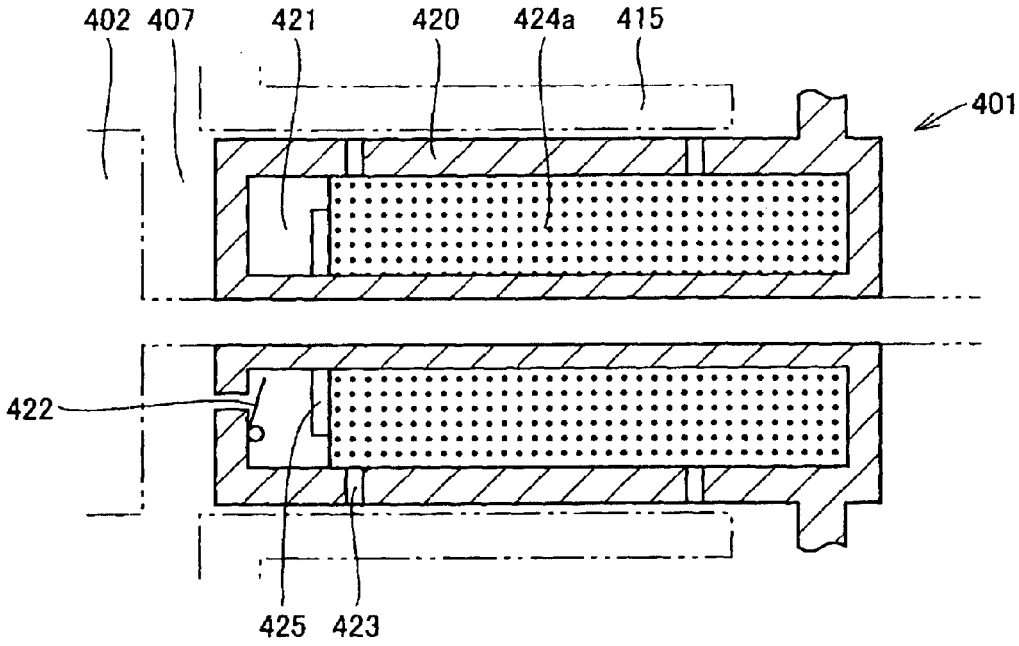
FIG. 27 is a sectional view of a piston in a seventeenth embodiment based on the present invention.

A Stirling refrigerator according to a seventeenth embodiment based on the present invention is described with reference to FIGS. 27, 28 and 35. A free-piston Stirling refrigerator as the Stirling refrigerator according to this embodiment is roughly identical in structure to the conventional one shown in FIG. 35. However, the structure of an internal space 421 of a piston 401 is different from that of the conventional one (see FIG. 36), as shown in FIG. 27. A lightweight internal member 424*a* is arranged in the internal space 421 of the piston 401. A material having specific heat of at least 1 kJ/kg·K is employed for the lightweight internal member 424*a*, among conditions for the material shown in the sixteenth embodiment. As a specific example, polyester fiber or absorbent cotton can be employed in this embodiment. Such a material having an indeterminate shape is inserted up to a position of a constant distance from a check valve 422 not to hinder operation of the check valve 422 by moving or spreading in the internal space 421, and is stopped by a partition plate 425 serving as interference avoidance means. The partition plate 425 is fixed by providing fixing means (not shown) on a part forming the outer periphery of a rod 409 of the piston 401. In the structure shown in FIG. 27, a passage for working gas directed toward a gas bearing hole 423 appears to be also completely filled up to the outer periphery of the internal space 421 without defining a clearance in particular dissimilarly to the structure shown in FIG. 25, while this is because the working gas can freely pass through the lightweight internal member 424*a* if polyester fiber or the like is employed for the lightweight internal member 424*a* not to hinder the working gas flowing toward the gas bearing hole 423.

(Function/Effect)

The capacity of the internal space 421 can be reduced while keeping the outer shell 420 thin and keeping the internal space 421 large for reducing the weight of the piston 401 due to the arrangement of the lightweight internal member 424*a*.

The lightweight internal member 424*a* having the large specific heat of at least 1 kJ/kg·K is so arranged in the internal space 421 that the lightweight internal member 424*a* serves to buffer heat conduction between a low temperature in a working space 412 and a relatively high temperature in a driving space 413. Therefore, the low-temperature working gas flowing into the internal space 421 from a compression space 407 can be prevented from abruptly expanding due to temperature increase. Further, the capacity of the internal space 421 is reduced due to the arrangement of the lightweight internal member 424*a*. Consequently, the quantity of miscellaneous loss can be reduced.

Figure 28:
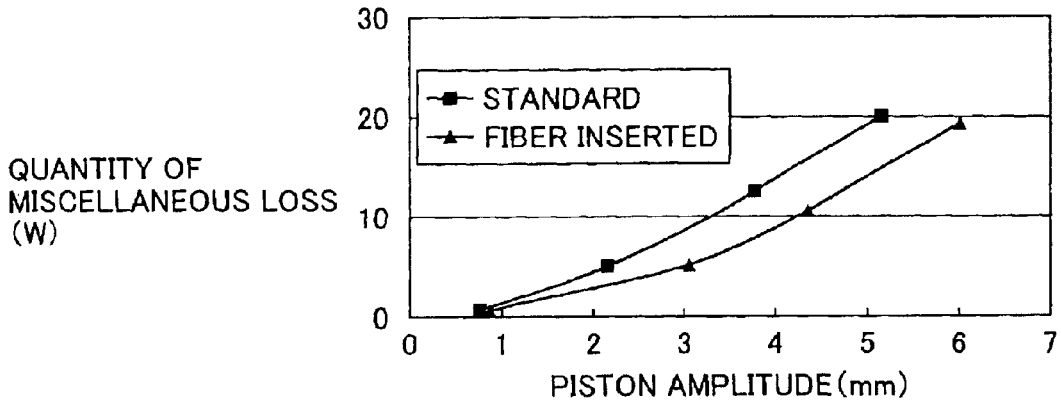
FIG. 28 is a graph comparing quantities of miscellaneous loss in a Stirling refrigerator according to the seventeenth embodiment based on the present invention and a conventional Stirling refrigerator.

FIG. 28 shows comparison of the conventional Stirling refrigerator comprising the piston shown in FIG. 36 and the Stirling refrigerator according to this embodiment comprising the piston shown in FIG. 27. In this example, an effect of reducing the quantity of miscellaneous loss by about 4 W is observed due to insertion of a polyester fiber material as the lightweight internal member 424*a*. The polyester fiber material is so light that increase of weight is extremely small also when the same is arranged to occupy most part of the internal space 421, not to exert remarkable influence on the dynamic system or performance of the Stirling refrigerator. Further, polyester fiber or absorbent cotton employed as the lightweight internal member 424*a* is extremely low-priced, and the cost required for manufacturing the piston 401 may not be much increased.

According to this embodiment, as hereinabove described, a Stirling refrigerator having small miscellaneous loss and excellent efficiency is obtained.

(Eighteenth Embodiment)

(Structure)

Figure 29:
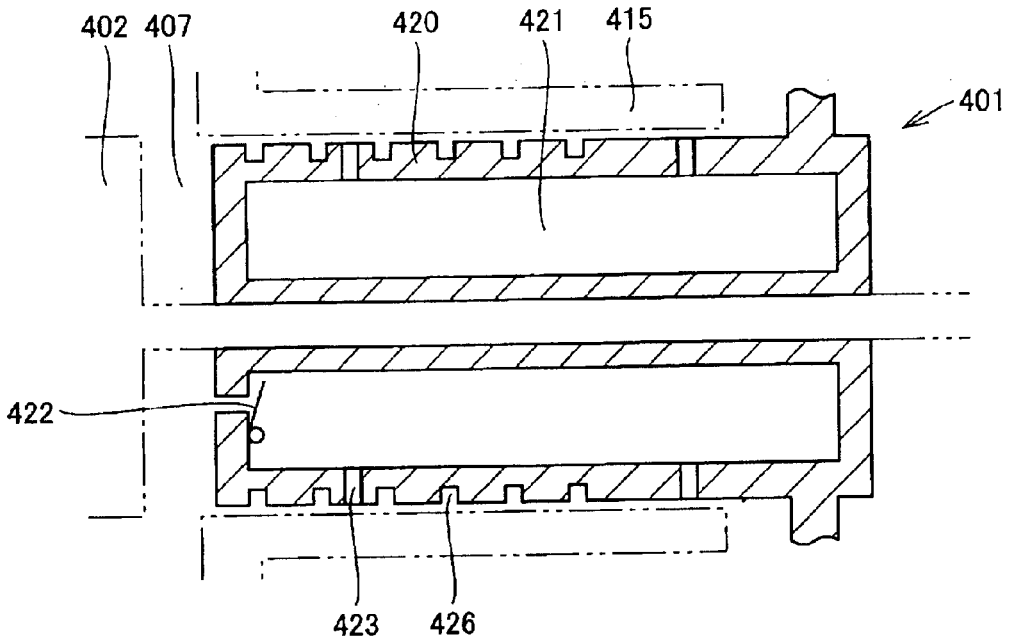
FIG. 29 is a sectional view of a first exemplary piston in an eighteenth embodiment based on the present invention.

A Stirling refrigerator according to the eighteenth embodiment based on the present invention is described with reference to FIGS. 29, 30 and 35. A free-piston Stirling refrigerator as the Stirling refrigerator according to this embodiment is roughly identical in structure to that of the conventional one shown in FIG. 35. However, the structure of an outer shell 420 of a piston 401 is different from the conventional one (see FIG. 36), as shown in FIG. 29. In other words, grooves 426 are provided on the outer surface of the outer shell 420 of the piston 401 in an enclosing manner.

(Function/Effect)

The piston 401 originally engages with a second cylinder 415 with a clearance of about several 10 $\mu$m and reciprocates thereby compressing/expanding working gas in a compression space 407. With respect to this, a single or a plurality of grooves 426 are present on the outer surface of the piston 401 thereby bringing a sealing effect due to the principle of a labyrinth seal, so that the working gas can be prevented from leaking oppositely to the compression space 407, i.e., toward a driving space 413. The working gas can be so prevented from leakage that leakage loss can be reduced, whereby the quantity of compression work of the piston 401 can be prevented from increase. Therefore, the quantity of miscellaneous loss of the Stirling refrigerator can be inhibited from increase. Further, the weight of the piston 401 is reduced due to the provision of the grooves 426, whereby the quantity of miscellaneous loss can be reduced also by this.

Figure 30:
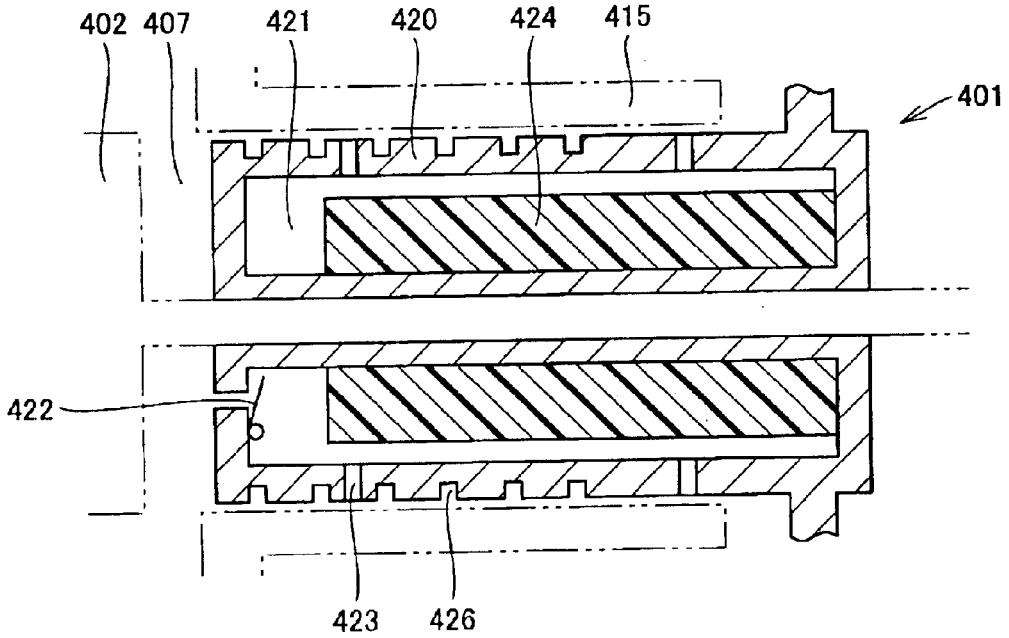
FIG. 30 is a sectional view of a second exemplary piston in the eighteenth embodiment based on the present invention.
Figure 31:
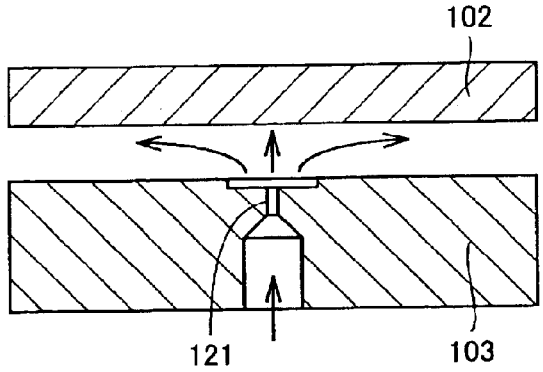
FIG.31 PRIOR ART
FIG. 31 is a sectional view schematically showing a first gas effusion structure according to first prior art.
Figure 32:
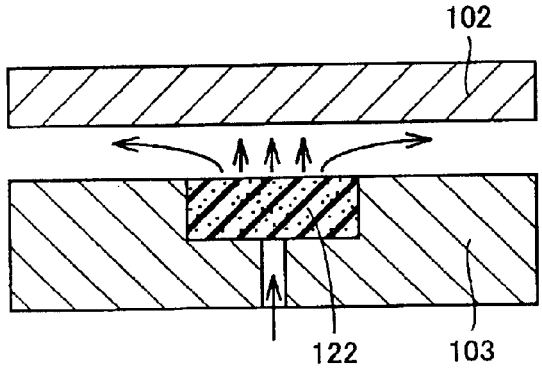
FIG.32 PRIOR ART
FIG. 32 is a sectional view schematically showing a second gas effusion structure according to the first prior art.
Figure 33:
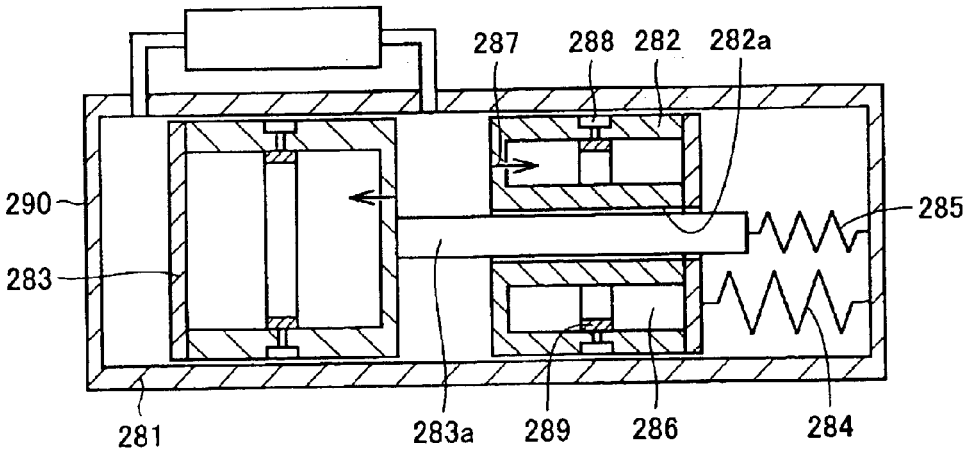
FIG.33 PRIOR ART
FIG. 33 is a sectional view showing the structure of a Stirling engine according to second prior art.
Figure 34:
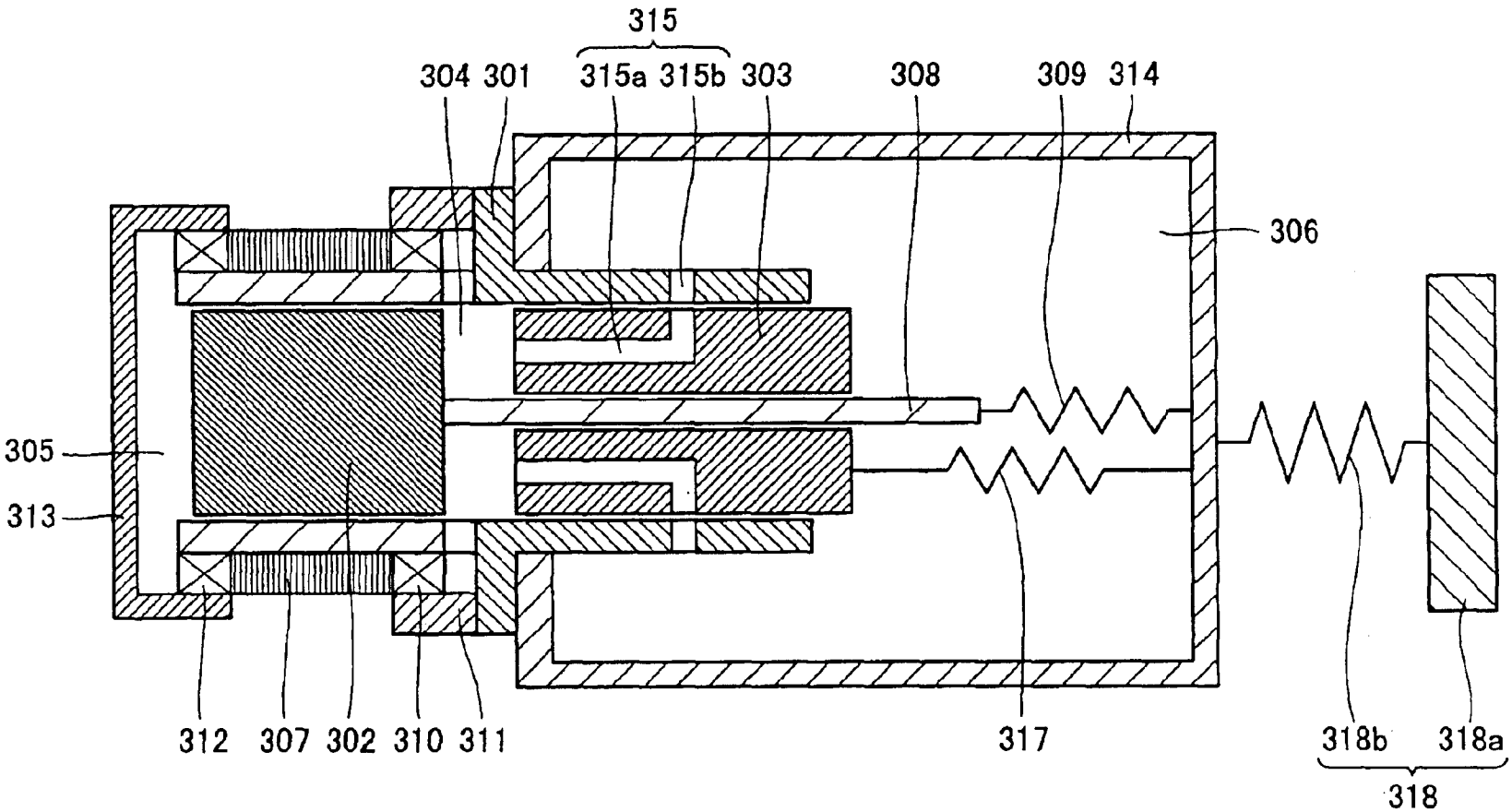
FIG.34 PRIOR ART
FIG. 34 is a sectional view for illustrating the structure of a Stirling engine according to third prior art.

While FIG. 29 shows an example arranging no element in the internal space 421, a lightweight internal member 424 of plastic or rubber may be arranged in the internal space 421 as shown in FIG. 30 by employing the structure of the sixteenth embodiment in coincidence with the structure of this embodiment. Alternatively, a lightweight internal member 424*a* of polyester fiber or absorbent cotton may be arranged in the internal space 421 by employing the idea of the seventeenth embodiment in coincidence with the structure of this embodiment, although this is not illustrated.

According to the present invention, the lightweight internal member is arranged in the internal space of the piston to block the space thereby reducing the capacity of the internal space, whereby the volume of a compressed region can be inhibited from increase even if the compression space and the internal space communicate with each other through a check valve when the piston compresses the compression space. Consequently, the quantity of compression work of the piston can be inhibited from increase, and increase of the quantity of miscellaneous loss of the Stirling refrigerator can be suppressed.

The aforementioned embodiments disclosed this time are illustrative and not restrictive in all points. The scope of the present invention is shown not by the above description but by the scope of claim for patent, and includes all modifications within the meaning and range equivalent to the scope of claim for patent.

INDUSTRIAL APPLICABILITY

As hereinabove described, the Stirling engine or the Stirling refrigerator according to the present invention is generally utilizable as a driving source or a refrigerator.

What is claimed is:

1. A Stirling engine comprising a gas bearing storing high-pressure gas generated by reciprocation of an effector arranged in a cylinder in a pressurization chamber provided in said effector for effusing said high-pressure gas in said effector to a sliding part between said cylinder and said effector, wherein a region of said effector including a sliding surface with said cylinder and said pressurization chamber is formed by a porous body.

2. A Stirling engine storing high-pressure gas resulting from reciprocation of an effector slidably arranged in a cylinder in a pressurization chamber provided in said effector for injecting the high-pressure gas in said pressurization chamber to a sliding part between said effector and said cylinder through a porous body provided inside a peripheral wall of said effector from a through hole provided on said peripheral wall.

3. The Stirling engine according to claim 2, wherein said porous body is an annular body having an axial slit on its outer peripheral surface.

4. The Stirling engine according to claim 2, wherein said porous body is fixed to said peripheral wall of said effector with a pin.

5. The Stirling engine according to claim 2, wherein said porous body consists of a synthetic resin material.

6. The Stirling engine according to claim 2, partially or entirely comprising a tapered surface on one or both of a contact surface of said porous body with the inner side of said peripheral wall of said effector and the inner side surface of said peripheral wall of said effector.

7. The Stirling engine according to claim 2, wherein said porous body includes a constraint portion consisting of a viscous synthetic resin material to be constrained to said peripheral wall partially or entirely on a contact surface with said peripheral wall of said effector.

8. The Stirling engine according to claim 7, wherein said constraint portion is provided to enclose the peripheral edge of said through hole.

9. The Stirling engine according to claim 2, wherein said porous body is partially notched in the circumferential direction.

10. The Stirling engine according to claim 9, wherein said porous body has a notched portion arranged on a surface, excluding an open end of the through hole, of the inner surface of the peripheral wall of said effector.

11. The Stirling engine according to claim 2, wherein said pressurization chamber has a step portion perpendicular to the direction of motion of said effector, and said porous body has a projection to be stopped by said step portion.

12. The Stirling engine according to claim 11, wherein said step portions are provided on two portions through an open end of said through hole.

13. A Stirling engine comprising a gas bearing storing high-pressure gas generated by reciprocation of an effector arranged in a cylinder in a pressurization chamber provided in said effector for effusing said high-pressure gas in said effector to a sliding part between said cylinder and said effector, wherein a first porous body is arranged upstream an effusion side for said high-pressure gas and a second porous body smaller in porosity than said first porous body is arranged downstream the effusion side for said high-pressure gas in an outlet for said high-pressure gas provided on a side wall portion of said effector.

14. The Stirling engine according to claim 13, wherein said first porous body and said second porous body are stacked/arranged along the radial direction of said cylinder in said pressurization chamber.

15. The Stirling engine according to claim 13, wherein said first porous body and said second porous body are stacked/arranged along the axial direction of said cylinder in said pressurization chamber.

16. The Stirling engine according to claim 13, wherein said first porous body and said second porous body are stacked/arranged along the radial direction of said cylinder in a hole provided in a side wall portion of said effector toward the radial direction.

17. The Stirling engine according to claim 13, wherein at least either one of said first porous body and said second porous body is made of resin.

18. The Stirling engine according to claim 13, wherein said effector is a piston.

19. The Stirling engine according to claim 13, wherein said effector is a displacer.

* * * * *